US009131298B2

(12) United States Patent
Kim et al.

(10) Patent No.: US 9,131,298 B2
(45) Date of Patent: Sep. 8, 2015

(54) CONSTRAINED DYNAMIC AMPLITUDE PANNING IN COLLABORATIVE SOUND SYSTEMS

(71) Applicant: QUALCOMM Incorporated, San Diego, CA (US)

(72) Inventors: Lae-Hoon Kim, San Diego, CA (US); Pei Xiang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 291 days.

(21) Appl. No.: 13/830,894

(22) Filed: Mar. 14, 2013

(65) Prior Publication Data

US 2014/0146984 A1 May 29, 2014

Related U.S. Application Data

(60) Provisional application No. 61/730,911, filed on Nov. 28, 2012.

(51) Int. Cl.
*H04R 5/02* (2006.01)
*H04R 5/00* (2006.01)
(Continued)

(52) U.S. Cl.
CPC .. *H04R 5/02* (2013.01); *H04R 5/00* (2013.01); *H04S 3/00* (2013.01); *H04R 2205/024* (2013.01); *H04R 2420/07* (2013.01); *H04S 7/308* (2013.01); *H04S 2400/13* (2013.01)

(58) Field of Classification Search
CPC ..... H04R 5/02
USPC ..... 381/307
See application file for complete search history.

(56) References Cited

U.S. PATENT DOCUMENTS 6,154,549 A 11/2000 Arnold et al.
6,757,517 B2 6/2004 Chang
7,539,551 B2 5/2009 Komura et al.
(Continued)

FOREIGN PATENT DOCUMENTS

EP 1615464 A1 1/2006
JP 2008078938 A 4/2008

OTHER PUBLICATIONS

Goodwin Michael M et al: "Multichannel Surround Format Conversion and Generalized Upmix", Conference: 30th International Conference: Intelligent Audio Environments; Mar. 2007, AES, 60 East 42nd Street, Room 2520 New York 10165-2520, USA, Mar. 1, 2007, XP040508018.*
(Continued)

*Primary Examiner* — Mark Blouin
(74) *Attorney, Agent, or Firm* — Shumaker & Sieffert, P.A.

(57) ABSTRACT

In general, techniques are described for performing constrained dynamic amplitude panning in collaborative sound systems. A headend device comprising one or more processors may perform the techniques. The processors may be configured to identify, for a mobile device participating in a collaborative surround sound system, a specified location of a virtual speaker of the collaborative surround sound system and determine a constraint that impacts playback of audio signals rendered from an audio source by the mobile device. The processors may be further configure to perform dynamic spatial rendering of the audio source with the determined constraint to render audio signals that reduces the impact of the determined constraint during playback of the audio signals by the mobile device.

36 Claims, 19 Drawing Sheets

(51) Int. Cl.
*H04S 3/00* (2006.01)
*H04S 7/00* (2006.01)

(56) References Cited

U.S. PATENT DOCUMENTS

| | | | | |
|---|---|---|---|---|
| 8,126,157 | B2 | 2/2012 | Buil et al. | |
| 2002/0072816 | A1 | 6/2002 | Shdema et al. | |
| 2005/0190928 | A1 | 9/2005 | Noto | |
| 2005/0286546 | A1 | 12/2005 | Bassoli et al. | |
| 2006/0177073 | A1 | 8/2006 | Isaac et al. | |
| 2007/0025555 | A1* | 2/2007 | Gonai et al. | 381/17 |
| 2007/0087686 | A1 | 4/2007 | Holm et al. | |
| 2007/0116306 | A1 | 5/2007 | Riedel et al. | |
| 2008/0077261 | A1* | 3/2008 | Baudino et al. | 700/94 |
| 2008/0216125 | A1 | 9/2008 | Li et al. | |
| 2010/0048139 | A1* | 2/2010 | Seo et al. | 455/67.11 |
| 2010/0284389 | A1 | 11/2010 | Ramsay et al. | |
| 2011/0091055 | A1 | 4/2011 | Leblanc | |
| 2011/0150228 | A1 | 6/2011 | Yoon et al. | |
| 2011/0270428 | A1 | 11/2011 | Tam | |
| 2012/0113224 | A1 | 5/2012 | Nguyen et al. | |
| 2014/0146970 | A1 | 5/2014 | Kim et al. | |
| 2014/0146983 | A1 | 5/2014 | Kim et al. | |

OTHER PUBLICATIONS

Goodwin et al., "Multichannel Surround Format Conversion and Generalized Upmix", Conference: 30th International Conference: Intelligent Audio Environments; Mar. 2007, AES, 60 East 42nd Street, Room 2520 New York 10165-2520, USA, Mar. 1, 2007, XP040508018, 9 pp.

International Search Report and Written Opinion—PCT/US2013/067119—ISA/EPO—Feb. 3, 2014, 12 pp.

International Search Report and Written Opinion—PCT/US2013/067120—ISA/EPO—Feb. 3, 2014, 10 pp.

International Search Report and Written Opinion—PCT/US2013/067124—ISA/EPO—Feb. 3, 2014, 13 pp.

Second Written Opinion from International Application No. PCT/US2013/067124, dated Nov. 4, 2014, 6 pp.

International Preliminary Report on Patentability from International Application No. PCT/US2013/067124, mailed Mar. 6, 2015, 7 pp.

* cited by examiner

CONSTRAINED DYNAMIC AMPLITUDE PANNING IN COLLABORATIVE SOUND SYSTEMS

This application claims the benefit of U.S. Provisional Application No. 61/730,911, filed Nov. 28, 2012.

TECHNICAL FIELD

The disclosure relates to multi-channel sound system and, more particularly, collaborative multi-channel sound systems.

BACKGROUND

A typical multi-channel sound system (which may also be referred to as a "multi-channel surround sound system") typically includes an audio/video (AV) receiver and two or more speakers. The AV receiver typically includes a number of outputs to interface with the speakers and a number of inputs to receive audio and/or video signals. Often, the audio and/or video signals are generated by various home theater or audio components, such as television sets, digital video disc (DVD) players, high-definition video players, game systems, record players, compact disc (CD) players, digital media players, set-top boxes (STBs), laptop computers, tablet computers and the like.

While the AV receiver may process video signals to provide up-conversion or other video processing functions, typically the AV receiver is utilized in a surround sound system to perform audio processing so as to provide the appropriate channel to the appropriate speakers (which may also be referred to as "loudspeakers"). A number of different surround sound formats exist to replicate a stage or area of sound and thereby better present a more immersive sound experience. In a 5.1 surround sound system, the AV receiver processes five channels of audio that include a center channel, a left channel, a right channel, a rear right channel and a rear left channel. An additional channel, which forms the "0.1" of 5.1, is directed to a subwoofer or bass channel. Other surround sound formats include a 7.1 surround sound format (that adds additional rear left and right channels) and a 22.2 surround sound format (which adds additional channels at varying heights in addition to additional forward and rear channels and another subwoofer or bass channel).

In the context of a 5.1 surround sound format, the AV receiver may process these five channels and distribute the five channels to the five loudspeakers and a subwoofer. The AV receiver may process the signals to change volume levels and other characteristics of the signal so as to adequately replicate the surround sound audio in the particular room in which the surround sound system operates. That is, the original surround sound audio signal may have been captured and rendered to accommodate a given room, such as a 15×15 foot room. The AV receiver may render this signal to accommodate the room in which the surround sound system operates. The AV receiver may perform this rendering to create a better sound stage and thereby provide a better or more immersive listening experience.

Although surround sound may provide a more immersive listening (and, in conjunction with video, viewing) experience, the AV receiver and loudspeakers required to reproduce convincing surround sound are often expensive. Moreover, to adequately power the loudspeakers, the AV receiver must often be physically coupled (typically via speaker wire) to the loudspeakers. Given that surround sound typically requires that at least two speakers be positioned behind the listener, the AV receiver often requires that speaker wire or other physical connections be run across a room to physically connect the AV receiver to the left rear and right rear speakers in the surround sound system. Running these wires may be unsightly and prevent adoption of 5.1, 7.1 and higher order surround sound systems by consumers.

SUMMARY

In general, this disclosure describes techniques by which to enable a collaborative surround sound system that employs available mobile devices as surround sound speakers or, in some instances, as front left, center and/or front right speakers. A headend device may be configured to perform the techniques described in this disclosure. The headend device may be configured to interface with one or more mobile devices to form a collaborative sound system. The headend device may interface with one or more mobile devices to utilize speakers of these mobile devices as speakers of the collaborative sound system. Often the headend device may communicate with these mobile devices via a wireless connection, utilizing the speakers of the mobile devices for rear-left, rear-right, or other rear positioned speakers in the sound system.

In this way, the headend device may form a collaborative sound system using speakers of mobile devices that are generally available but not utilized in conventional sound systems, thereby enabling users to avoid or reduce costs associated with purchasing dedicated speakers. In addition, given that the mobile devices may be wirelessly coupled to the headend device, the collaborative surround sound system formed in accordance with the techniques described in this disclosure may enable rear sound without having to run speaker wire or other physical connections to provide power to the speakers. Accordingly, the techniques may promote both cost savings in terms of avoiding the cost associated with purchasing dedicated speakers and installation of such speakers and ease and flexibility of configuration in avoiding the need to provide dedicated physical connections coupling the rear speakers to the headend device.

In one aspect, A method comprises identifying, for a mobile device participating in a collaborative surround sound system, a specified location of a virtual speaker of the collaborative surround sound system, determining a constraint that impacts playback of audio signals rendered from an audio source by the mobile device, and performing dynamic spatial rendering of the audio source with the determined constraint to render audio signals that reduces the impact of the determined constraint during playback of the audio signals by the mobile device.

In another aspect, a headend device comprises one or more processors configured to identify, for a mobile device participating in a collaborative surround sound system, a specified location of a virtual speaker of the collaborative surround sound system, determine a constraint that impacts playback of audio signals rendered from an audio source by the mobile device, and perform dynamic spatial rendering of the audio source with the determined constraint to render audio signals that reduces the impact of the determined constraint during playback of the audio signals by the mobile device.

In another aspect, a headend device comprises means for identifying, for a mobile device participating in a collaborative surround sound system, a specified location of a virtual speaker of the collaborative surround sound system, means for determining a constraint that impacts playback of audio signals rendered from an audio source by the mobile device, and means for performing dynamic spatial rendering of the audio source with the determined constraint to render audio signals that reduces the impact of the determined constraint during playback of the audio signals by the mobile device.

In another aspect, a non-transitory computer-readable storage medium has stored thereon instructions that, when executed cause one or more processors to identify, for a mobile device participating in a collaborative surround sound system, a specified location of a virtual speaker of the collaborative surround sound system, determine a constraint that impacts playback of audio signals rendered from an audio source by the mobile device, and perform dynamic spatial rendering of the audio source with the determined constraint to render audio signals that reduces the impact of the determined constraint during playback of the audio signals by the mobile device.

The details of one or more embodiments of the techniques are set forth in the accompanying drawings and the description below. Other features, objects, and advantages of the techniques will be apparent from the description and drawings, and from the claims.

DETAILED DESCRIPTION

Figure 1:
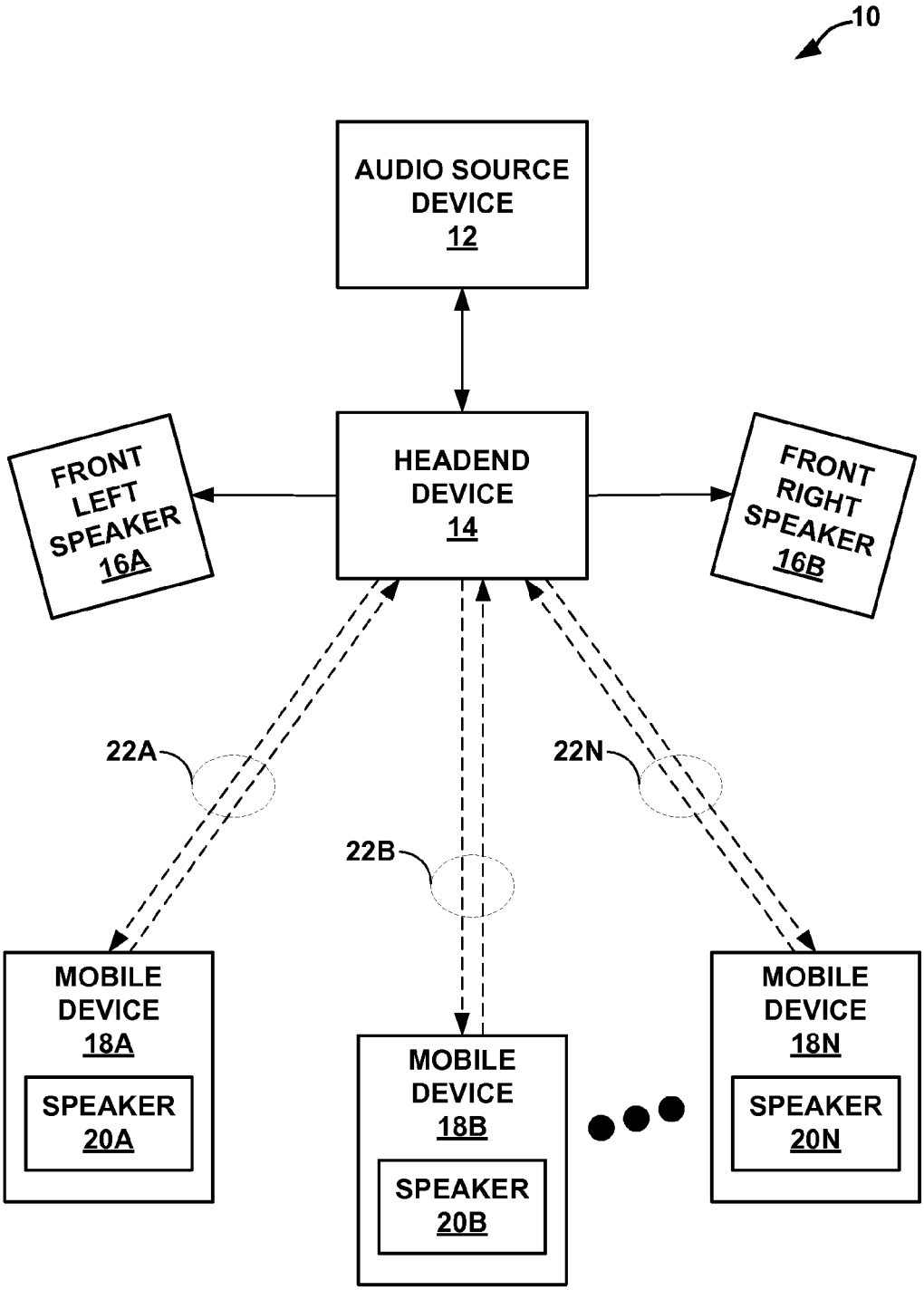
FIG. 1 is a block diagram illustrating an example collaborative surround sound system formed in accordance with the techniques described in this disclosure.

FIG. 1 is a block diagram illustrating an example collaborative surround sound system 10 formed in accordance with the techniques described in this disclosure. In the example of FIG. 1, the collaborative surround sound system 10 includes an audio source device 12, a headend device 14, a front left speaker 16A, a front right speaker 16B and mobile devices 18A-18N ("mobile devices 18"). While shown as including the dedicated front left speaker 16A and the dedicated front right speaker 16B, the techniques may be performed in instances where the mobile devices 18 are also used as front left, center and front right speakers. Accordingly, the techniques should not be limited to example the collaborative surround sound system 10 shown in the example of FIG. 1. Moreover, while described below with respect to the collaborative surround sound system 10, the techniques of this disclosure may be implemented by any form of sound system to provide a collaborative sound system.

The audio source device 12 may represent any type of device capable of generating source audio data. For example, the audio source device 12 may represent a television set (including so-called "smart televisions" or "smarTVs" that feature Internet access and/or that execute an operating system capable of supporting execution of applications), a digital set top box (STB), a digital video disc (DVD) player, a high-definition disc player, a gaming system, a multimedia player, a streaming multimedia player, a record player, a desktop computer, a laptop computer, a tablet or slate computer, a cellular phone (including so-called "smart phones), or any other type of device or component capable of generating or otherwise providing source audio data. In some instances, the audio source device 12 may include a display, such as in the instance where the audio source device 12 represents a television, desktop computer, laptop computer, tablet or slate computer, or cellular phone.

The headend device 14 represents any device capable of processing (or, in other words, rendering) the source audio data generated or otherwise provided by the audio source device 12. In some instances, the headend device 14 may be integrated with the audio source device 12 to form a single device, e.g., such that the audio source device 12 is inside or part of the headend device 14. To illustrate, when the audio source device 12 represents a television, desktop computer, laptop computer, slate or tablet computer, gaming system, mobile phone, or high-definition disc player to provide a few examples, the audio source device 12 may be integrated with the headend device 14. That is, the headend device 14 may be any of a variety of devices such as a television, desktop computer, laptop computer, slate or tablet computer, gaming system, cellular phone, or high-definition disc player, or the like. The headend device 14, when not integrated with the audio source device 12, may represent an audio/video receiver (which is commonly referred to as a "A/V receiver") that provides a number of interfaces by which to communicate either via wired or wireless connection with the audio source device 12, the front left speaker 16A, the front right speaker 16B and/or the mobile devices 18.

The front left speaker 16A and the front right speaker 16B ("speakers 16") may represent loudspeakers having one or more transducers. Typically, the front left speaker 16A is similar to or nearly the same as the front right speaker 16B. The speakers 16 may provide for a wired and/or, in some instances wireless interfaces by which to communicate with the headend device 14. The speakers 16 may be actively powered or passively powered, where, when passively powered, the headend device 14 may drive each of the speakers 16. As noted above, the techniques may be performed without the dedicated speakers 16, where the dedicated speakers 16 may be replaced by one or more of the mobile devices 18. In some instances, the dedicated speakers 16 may be incorporated into or otherwise integrated into the audio source device 12.

The mobile devices 18 typically represent cellular phones (including so-called "smart phones"), tablet or slate computers, netbooks, laptop computers, digital picture frames, or any other type of mobile device capable of executing applications and/or capable of interfacing with the headend device 14 wirelessly. The mobile devices 18 may each comprise a speaker 20A-20N ("speakers 20"). These speakers 20 may each be configured for audio playback and, in some instances, may be configured for speech audio playback. While described with respect to cellular phones in this disclosure for ease of illustration, the techniques may be implemented with respect to any portable device that provides a speaker and that is capable of wired or wireless communication with the headend device 14.

In a typical multi-channel sound system (which may also be referred to as a "multi-channel surround sound system" or "surround sound system"), the A/V receiver, which may represent as one example a headend device, processes the source audio data to accommodate the placement of dedicated front left, front center, front right, back left (which may also be referred to as "surround left") and back right (which may also be referred to as "surround right") speakers. The A/V receiver often provides for a dedicated wired connection to each of these speakers so as to provide better audio quality, power the speakers and reduce interference. The A/V receiver may be configured to provide the appropriate channel to the appropriate speaker.

A number of different surround sound formats exist to replicate a stage or area of sound and thereby better present a more immersive sound experience. In a 5.1 surround sound system, the A/V receiver renders five channels of audio that include a center channel, a left channel, a right channel, a rear right channel and a rear left channel. An additional channel, which forms the "0.1" of 5.1, is directed to a subwoofer or bass channel. Other surround sound formats include a 7.1 surround sound format (that adds additional rear left and right channels) and a 22.2 surround sound format (which adds additional channels at varying heights in addition to additional forward and rear channels and another subwoofer or bass channel).

In the context of a 5.1 surround sound format, the A/V receiver may render these five channels for the five loudspeakers and a bass channel for a subwoofer. The A/V receiver may render the signals to change volume levels and other characteristics of the signal so as to adequately replicate the surround sound audio in the particular room in which the surround sound system operates. That is, the original surround sound audio signal may have been captured and processed to accommodate a given room, such as a 15×15 foot room. The A/V receiver may process this signal to accommodate the room in which the surround sound system operates. The A/V receiver may perform this rendering to create a better sound stage and thereby provide a better or more immersive listening experience.

While surround sound may provide a more immersive listening (and, in conjunction with video, viewing) experience, the A/V receiver and speakers required to reproduce convincing surround sound are often expensive. Moreover, to adequately power the speakers, the A/V receiver must often be physically coupled (typically via speaker wire) to the loudspeakers for the reasons noted above. Given that surround sound typically requires that at least two speakers be positioned behind the listener, the A/V receiver often requires that speaker wire or other physical connections be run across a room to physically connect the A/V receiver to the left rear and right rear speakers in the surround sound system. Running these wires may be unsightly and prevent adoption of 5.1, 7.1 and higher order surround sound systems by consumers.

In accordance with the techniques described in this disclosure, the headend device 14 may interface with the mobile devices 18 to form the collaborative surround sound system 10. The headend device 14 may interface with the mobile devices 18 to utilize the speakers 20 of these mobile devices as surround sound speakers of the collaborative surround sound system 10. Often, the headend device 14 may communicate with these mobile devices 18 via a wireless connection, utilizing the speakers 20 of the mobile devices 18 for rear-left, rear-right, or other rear positioned speakers in the surround sound system 10, as shown in the example of FIG. 1.

In this way, the headend device 14 may form the collaborative surround sound system 10 using the speakers 20 of the mobile devices 18 that are generally available but not utilized in conventional surround sound systems, thereby enabling users to avoid costs associated with purchasing dedicated surround sound speakers. In addition, given that the mobile devices 18 may be wirelessly coupled to the headend device 14, the collaborative surround sound system 10 formed in accordance with the techniques described in this disclosure may enable rear surround sound without having to run speaker wire or other physical connections to provide power to the speakers. Accordingly, the techniques may promote both cost savings in terms of avoiding the cost associated with purchasing dedicated surround sound speakers and installation of such speakers and ease of configuration in avoiding the need to provide dedicated physical connections coupling the rear speakers to the headend device.

In operation, the headend device 14 may initially identify those of mobile devices 18 that each includes a corresponding one of the speakers 20 and that are available to participate in the collaborative surround sound system 10 (e.g., those of mobile device 18 that are powered on or operational). In some instances, the mobile device 18 may each execute an application (which may be commonly referred to as an "app") that enables the headend device 18 to identify those of mobile devices 18 executing the app as being available to participate in the collaborative surround sound system 10.

The headend device 14 may then configure the identified mobile devices 18 to utilize the corresponding ones of the speakers 20 as one or more speakers of the collaborative surround sound system 10. In some examples, the headend device 14 may poll or otherwise request that the mobile devices 18 provide mobile device data that specifies aspects of the corresponding one of the identified mobile devices 18 that impacts audio playback of the source audio data generated by audio data source 12 (where such source audio data may also be referred to, in some instances, as "multi-channel audio data") to aid in the configuration of the collaborative surround sound system 10. The mobile devices 18 may, in some instances, automatically provide this mobile device data upon communicating with the headend device 14 and periodically update this mobile device data in response to changes to this information without the headend device 14 requesting this information. The mobile devices 18 may, for example, provide updated mobile device data when some aspect of the mobile device data has changed.

In the example of FIG. 1, the mobile devices 18 wirelessly couple with the headend device 14 via a corresponding one of sessions 22A-22N ("sessions 22"), which may also be referred to as "wireless sessions 22." The wireless sessions 22 may comprise a wireless session formed in accordance with the Institute of Electrical and Electronics Engineers (IEEE) 802.11a specification, IEEE 802.11b specification, IEEE 802.11g specification, IEEE 802.11n specification, IEEE 802.11ac specification, and 802.11ad specification, as well as, any type of personal area network (PAN) specifications, and the like. In some examples, the headend device 14 couples to a wireless network in accordance with one of the above described specifications and the mobile devices 18 couple to the same wireless network, whereupon the mobile devices 18 may register with the headend device 14, often by executing the application and locating the headend device 14 within the wireless network.

After establishing the wireless sessions 22 with the headend device 14, the mobile devices 18 may collect the above mentioned mobile device data, providing this mobile device data to the headend device 14 via respective ones of the wireless sessions 22. This mobile device data may include any number of characteristics. Example characteristics or aspects specified by the mobile device data may include one or more of a location of the corresponding one of the identified mobile devices (using GPS or wireless network triangulation if available), a frequency response of corresponding ones of the speakers 20 included within each of identified the mobile devices 18, a maximum allowable sound reproduction level of the speaker 20 included within the corresponding one of the identified mobile devices 18, a battery status or power level of a batter of the corresponding one of the identified mobile devices 18, a synchronization status of the corresponding one of the identified mobile devices 18 (e.g., whether or not the mobile devices 18 are synced with the headend device 14), and a headphone status of the corresponding one of the identified mobile devices 18.

Based on this mobile device data, the headend device 14 may configure the mobile devices 18 to utilize the speakers 20 of each of these mobile devices 18 as one or more speakers of the collaborative surround sound system 10. For example, assuming that the mobile device data specifies a location of each of the mobile devices 18, the headend device 14 may determine that the one of the identified mobile devices 18 is not in an optimal location for playing the multi-channel audio source data based on the location of this one of the mobile devices 18 specified by the corresponding mobile device data.

In some instances, the headend device 14 may, in response to determining that one or more of the mobile devices 18 are not in what may be characterized as "optimal locations," configure the collaborative surround sound system 10 to control playback of the audio signals rendered from the audio source in a manner that accommodates the sub-optimal location(s) of one or more of the mobile devices 18. That is, the headend device 14 may configure one or more pre-processing functions by which to render the source audio data so as to accommodate the current location of the identified mobile devices 18 and provide a more immersive surround sound experience without having to bother the user to move the mobile devices.

To explain further, the headend device 14 may render audio signals from the source audio data so as to effectively relocate where the audio appears to originate during playback of the rendered audio signals. In this sense, the headend device 14 may identify a proper or optimal location of the one of the mobile devices 18 that is determined to be out of position, establishing what may be referred to as a virtual speaker of the collaborative surround sound system 10. The headend device 14 may, for example, crossmix or otherwise distribute audio signals rendered from the source audio data between two or more of the speakers 16 and 20 to generate the appearance of such a virtual speaker during playback of the source audio data. More detail as to how this audio source data is rendered to create the appearance of virtual speakers is provided below with respect to the example of FIG. 4.

In this manner, the headend device 14 may identify those of mobile devices 18 that each include a respective one of the speakers 20 and that are available to participate in the collaborative surround sound system 10. The headend device 14 may then configure the identified mobile devices 18 to utilize each of the corresponding speakers 20 as one or more virtual speakers of the collaborative surround sound system. The headend device 14 may then render audio signals from the audio source data such that, when the audio signals are played by the speakers 20 of the mobile devices 18, the audio playback of the audio signals appears to originate from one or more virtual speakers of the collaborative surround sound system 10, which are often placed in a location different than a location of at least one of the mobile devices 18 (and their corresponding one of the speakers 20). The headend device 14 may then transmit the rendered audio signals to the speakers 16 and 20 of the collaborative surround sound system 10.

In some instances, the headend device 14 may prompt a user of one or more of the mobile devices 18 to re-position these ones of the mobile devices 18 so as to effectively "optimize" playback of the audio signals rendered from the multi-channel source audio data by the one or more of the mobile devices 18.

In some examples, headend device 14 may render audio signals from the source audio data based on the mobile device data. To illustrate, the mobile device data may specify a power level (which may also be referred to as a "battery status") of the mobile devices. Based on this power level, the headend device 14 may render audio signals from the source audio data such that some portion of the audio signals have less demanding audio playback (in terms of power consumption to play the audio). The headend device 14 may then provide these less demanding audio signals to those of the mobile devices 18 having reduced power levels. Moreover, the headend device 14 may determine that two or more of the mobile devices 18 are to collaborate to form a single speaker of the collaborative surround sound system 10 to reduce power consumption during playback of the audio signals that form the virtual speaker when the power levels of these two or more of the mobile devices 18 are insufficient to complete playback of the assigned channel given the known duration of the source audio data. The above power level adaptation is described in more detail with respect to FIGS. 9A-9C and 10.

The headend device 14 may, additionally, determine speaker sectors at which each of the speakers of the collaborative surround sound system 10 are to be placed. Headend device 14 may then prompt the user to re-position the corresponding ones of the mobile devices 18 that may be in sub-optimal locations in a number of different ways. In one way, the headend device 14 may interface with the sub-optimally placed ones of the mobile devices 18 to be re-positioned and indicate the direction in which the mobile device is to be moved to re-position these ones of the mobile devices 18 in a more optimal location (such as within its assigned speaker sector). Alternatively, the headend device 18 may interface with a display, such as a television, to present an image identifying the current location of the mobile device and a more optimal location to which the mobile device should be moved. The following alternatives for prompting a user to reposition a sub-optimally placed mobile device are described in more detail with respect to FIGS. 5, 6A-6C, 7A-7C and 8A-8C.

In this way, the headend device 14 may be configured to determine a location of the mobile devices 18 participating in the collaborative surround sound system 10 as a speaker of a plurality of speakers of the collaborative surround sound system 10. The headend device 14 may also be configured to generate an image that depicts the location of the mobile devices 18 that are participating in the collaborative surround sound system 10 relative to the plurality of other speakers of the collaborative surround sound system 10.

The headend device 14 may, however, configure pre-processing functions to accommodate a wide assortment of mobile devices and contexts. For example, the headend device 14 may configure an audio pre-processing function by which to render the source audio data based on the one or more characteristics of the speakers 20 of the mobile devices 18, e.g., the frequency response of the speakers 20 and/or the maximum allowable sound reproduction level of the speakers 20.

As yet another example, the headend device 20 may, as noted above, receive mobile device data indicating a battery status or power level of the mobile devices 18 being utilized as speakers in the collaborative surround sound system 10. The headend device 14 may determine that the power level of one or more of these mobile devices 18 specified by this mobile device data is insufficient to complete playback of the source audio data. The headend device 14 may then configure a pre-processing function to render the source audio data to reduce an amount of power required by these ones of the mobile device 18 to play the audio signals rendered from the multi-channel source audio data based on the determination that the power level of these mobile devices 18 is insufficient to complete playback of the multi-channel source audio data.

The headend device 14 may configure the pre-processing function to reduce power consumption at these mobile devices 18 by, as one example, adjusting the volume of the audio signals rendered from the multi-channel source audio data for playback by these ones of mobile devices 18. In another example, headend device 14 may configure the pre-processing function to cross-mix the audio signals rendered from the multi-channel source audio data to be played by these mobile devices 18 with audio signals rendered from the multi-channel source audio data to be played by other ones of the mobile devices 18. As yet another example, the headend device 14 may configure the pre-processing function to reduce at least some range of frequencies of the audio signals rendered from the multi-channel source audio data to be played by those of mobile devices 18 lacking sufficient power to complete playback (so as to remove, as an example, the low end frequencies).

In this way, the headend device 14 may apply pre-processing functions to source audio data to tailor, adapt or otherwise dynamically configure playback of this source audio data to suit the various needs of users and accommodate a wide variety of the mobile devices 18 and their corresponding audio capabilities.

Once the collaborative surround sound system 10 is configured in the various ways described above, the headend system 14 may then begin transmitting the rendered audio signals to each of the one or more speakers of the collaborative surround sound system 10, where again one or more of the speakers 20 of the mobile devices 18 and/or the speakers 16 may collaborate to form a single speaker of the collaborative surround sound system 10.

During playback of the source audio data, one or more of the mobile devices 18 may provide updated mobile device data. In some instances, the mobile devices 18 may stop participating as speakers in the collaborative surround sound system 10, providing updating mobile device data to indicate that the corresponding one of the mobile devices 18 will no longer participate in the collaborative surround sound system 10. The mobile devices 18 may stop participating due to power limitations, preferences set via the application executing on the mobile devices 18, receipt of a voice call, receipt of an email, receipt of a text message, receipt of a push notification, or for any number of other reasons. The headend device 14 may then reformulate the pre-processing functions to accommodate the change in the number of the mobile devices 18 that are participating in the collaborative surround sound system 10. In one example, the headend device 14 may not prompt users to move their corresponding ones of the mobile devices 18 during playback but may instead render the multi-channel source audio data to generate audio signals that simulate the appearance of virtual speakers in the manner described above.

In this way, the techniques of this disclosure effectively enable the mobile devices 18 to participate in the collaborative surround sound system 10 by forming an ad-hoc network (which is commonly an 802.11 or PAN, as noted above) with the central device or the headend system 14 coordinating the formation of this ad-hoc network. The headend device 14 may identify the mobile devices 18 that include one of the speakers 20 and that are available to participate in the ad hoc wireless network of the mobile devices 18 to play audio signals rendered from the multi-channel source audio data, as described above. The headend device 14 may then receive the mobile device data from each of the identified mobile devices 18 specifying aspects or characteristics of the corresponding one of the identified mobile devices 18 that may impact audio playback of the audio signals rendered from the multi-channel source audio data. The headend device 14 may then configure the ad hoc wireless network of the mobile devices 18 based on the mobile device data so as to control playback of the audio signals rendered from the multi-channel source audio data in a manner that accommodates the aspects of the identified mobile devices 18 impacting the audio playback of the multi-channel source audio data.

While described above as being directed to the collaborative surround sound system 10 that include the mobile devices 18 and the dedicated speakers 16, the techniques may be performed with respect to any combination of the mobile devices 18 and/or the dedicated speakers 16. In some instances, the techniques may be performed with respect to a collaborative surround sound system that includes only mobile devices. The techniques should therefore not be limited to the example of FIG. 1.

Moreover, while described throughout the description as being performed with respect to multi-channel source audio data, the techniques may be performed with respect to any type of source audio data, including object-based audio data and higher order ambisonic (HOA) audio data (which may specify audio data in the form of hierarchical elements, such as spherical harmonic coefficients (SHC)). HOA audio data is described below in more detail with respect to FIGS. 11-13.

Figure 2:
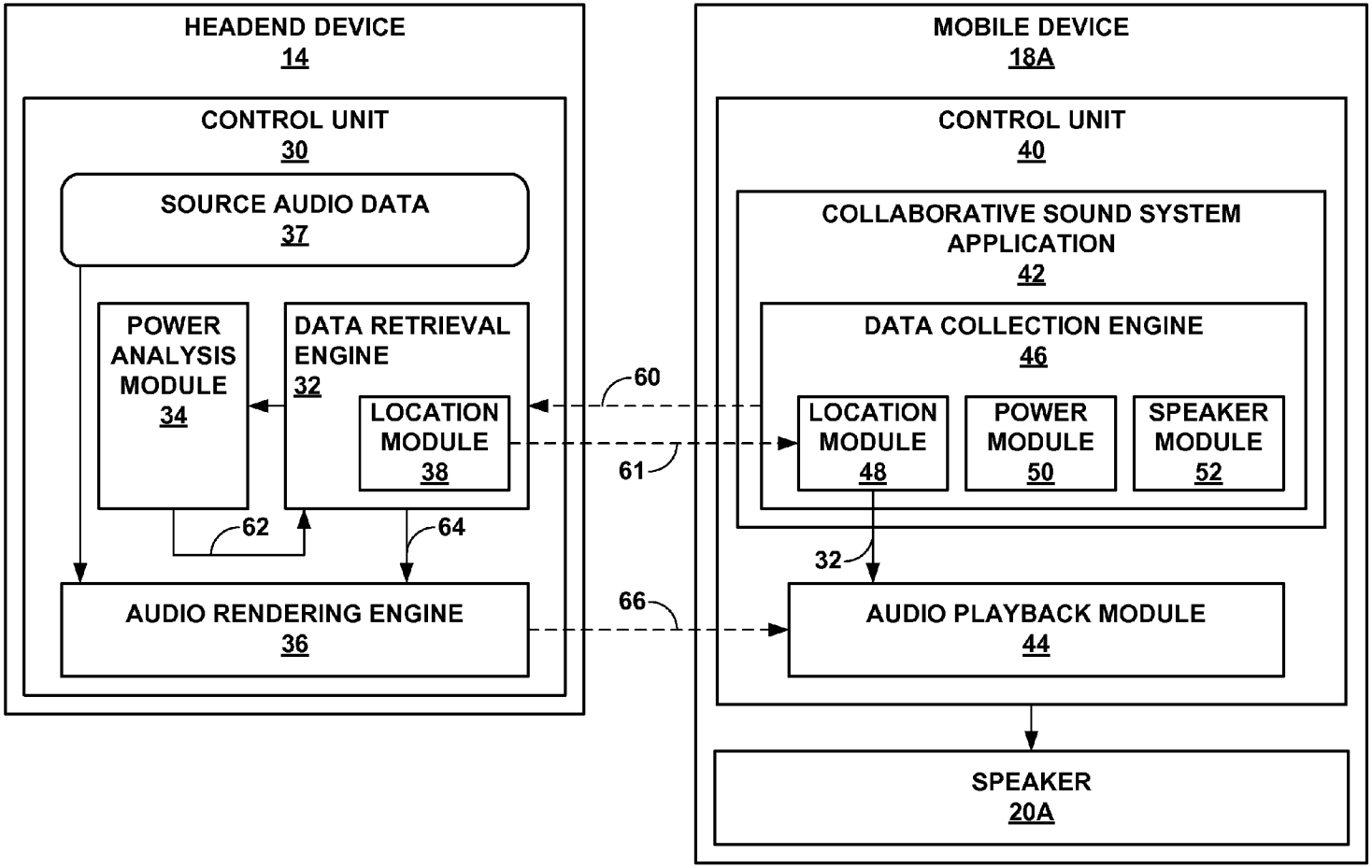
FIG. 2 is a block diagram illustrating various aspects of the collaborative surround sound system of FIG. 1 in more detail.

FIG. 2 is a block diagram illustrating a portion of the collaborative surround sound system 10 of FIG. 1 in more detail. The portion of the collaborative surround sound system 10 shown in FIG. 2 includes the headend device 14 and the mobile device 18A. While described below with respect to a single mobile device, i.e., the mobile device 18A in the example of FIG. 2, for ease of illustration purposes, the techniques may be implemented with respect to multiple mobile devices, e.g., the mobile devices 18 shown in the example of FIG. 1.

As shown in the example of FIG. 2, the headend device 14 includes a control unit 30. The control unit 30 (which may also be generally referred to as a processor) may represent one or more central processing units and/or graphical processing units (both of which are not shown in FIG. 2) that execute software instructions, such as those used to define a software or computer program, stored to a non-transitory computer-readable storage medium (again, not shown in FIG. 2), such as a storage device (e.g., a disk drive, or an optical drive), or memory (such as Flash memory, random access memory or RAM) or any other type of volatile or non-volatile memory, that stores instructions to cause the one or more processors to perform the techniques described herein. Alternatively, the control unit 30 may represent dedicated hardware, such as one or more integrated circuits, one or more Application Specific Integrated Circuits (ASICs), one or more Application Specific Special Processors (ASSPs), one or more Field Programmable Gate Arrays (FPGAs), or any combination of one or more of the foregoing examples of dedicated hardware, for performing the techniques described herein.

The control unit 30 may execute or otherwise be configured to implement a data retrieval engine 32, a power analysis module 34 and an audio rendering engine 36. The data retrieval engine 32 may represent a module or unit configured to retrieve or otherwise receive the mobile device data 60 from the mobile device 18A (as well as, remaining mobile devices 18B-18N). The data retrieval engine 32 may include a location module 38 that determines a location of the mobile device 18A relative to the headend device 14 when a location is not provided by the mobile device 18A via the mobile device data 62. The data retrieval engine 32 may update the mobile device data 60 to include this determined location, thereby generating updated mobile device data 64.

The power analysis module 34 represents a module or unit configured to process power consumption data reported by the mobile devices 18 as a part of the mobile device data 60. Power consumption data may include a battery size of the mobile device 18A, an audio amplifier power rating, a model and efficiency of the speaker 20A and power profiles for the mobile device 18A for different processes (including wireless audio channel processes). The power analysis module 34 may process this power consumption data to determine refined power data 62, which is provided back to the data retrieval engine 32. The refined power data 62 may specify a current power level or capacity, intended power consumption rate in a given amount of time, etc. The data retrieval engine 32 may then update the mobile device data 60 to include this refined power data 62, thereby generating the updated mobile device data 64. In some instances, the power analysis module 34 provides the refined power data 62 directly to the audio rendering engine 36, which combines this refined power data 62 with the updated mobile device data 64 to further update the updated mobile device data 64.

The audio rendering engine 36 represents a module or unit configured to receive the updated mobile device data 64 and process the source audio data 37 based on the updated mobile device data 64. The audio rendering engine 36 may process the source audio data 37 in any number of ways, which are described below in more detail. While shown as only processing the source audio data 37 with respect to the updated mobile device data 64 from a single mobile device, i.e., the mobile device 18A in the example of FIG. 2, the data retrieval engine 32 and the power analysis module 64 may retrieve the mobile device data 60 from each of the mobile devices 18, generating the updated mobile device data 64 for each of the mobile devices 18, whereupon the audio rendering engine 36 may render the source audio data 37 based on each instance or a combination of multiple instances (such as when two or more of the mobile devices 18 are utilized to form a single speaker of the collaborative surround sound system 10) of the updated mobile device data 64. The audio rendering engine 36 outputs rendering audio signals 66 for playback by the mobile devices 18.

As further shown in FIG. 2, the mobile device 18A includes a control unit 40 and a speaker 20A. The control unit 40 may be similar or substantially similar to the control unit 30 of headend device 14. The speaker 20A represents one or more speakers by which mobile device may reproduce the source audio data 37 via playback of processed audio signals 66.

The control unit 40 may execute or otherwise be configured to implement the collaborative sound system application 42 and the audio playback module 44. The collaborative sound system application 42 may represent a module or unit configured to establish the wireless session 22A with the headend device 14 and then communicate the mobile device data 60 via this wireless session 22A to the headend device 14. The collaborative sound system application 42 may also periodically transmit the mobile device data 60 when the collaborative sound system application 42 detects a change in a status of the mobile device 60 that may impact playback of rendered audio signals 66. The audio playback module 44 may represent a module or unit configured to playback audio data or signals. The audio playback module 44 may present the rendered audio signals 66 to the speaker 20A for playback.

The collaborative sound system application 42 may include a data collection engine 46 that represents a module or unit configured to collect mobile device data 60. The data collection engine 46 may include a location module 48, a power module 50 and a speaker module 52. The location module 48 may, if possible, determine a location of the mobile device 18A relative to the headend device 14 using a global positioning system (GPS) or through wireless network triangulation. Often, the location module 48 may be unable to resolve the location of the mobile device 18A relative to headend device 14 with sufficient accuracy to permit the headend device 14 to properly perform the techniques described in this disclosure.

If this is the case, the location module 48 may then coordinate with the location module 38 executed or implemented by the control unit 30 of the headend device 14. The location module 38 may transmit a tone 61 or other sound to the location module 48, which may interface with the audio playback module 44 so that the audio playback module 44 causes the speaker 20A to playback this tone 61. The tone 61 may comprise a tone of a given frequency. Often, the tone 61 is not in a frequency range that is cable of being heard by the human auditory system. The location module 38 may then detect the playback of this tone 61 by the speaker 20A of the mobile device 18A and may derive or otherwise determine the location of the mobile device 18A based on the playback of this tone 61.

The power module 50 represents a unit or module configured to determine the above noted power consumption data, which may again include a size of a battery of the mobile device 18A, a power rating of an audio amplifier employed by the audio playback module 44, a model and power efficiency of the speaker 20A, and power profiles of various processes executed by the control unit 40 of the mobile device 18A (include wireless audio channel processes). The power module 50 may determine this information from system firmware, an operating system executed by the control unit 40 or from inspecting various system data. In some instances, the power module 50 may access a file server or some other data source accessible in a network (such as the Internet), providing the type, version, manufacture or other data identifying the mobile device 18A to the file server to retrieve various aspects of this power consumption data.

The speaker module 52 represents a module or unit configured to determine speaker characteristics. Similar to the power module 50, the speaker module 52 may collect or otherwise determine various characteristics of the speaker 20A, including a frequency range for the speaker 20A, a maximum volume level for the speaker 20A (often expressed in decibels (dB)), a frequency response of the speaker 20A, and the like. The speaker module 52 may determine this information from system firmware, an operating system executed by the control unit 40 or from inspecting various system data. In some instances, the speaker module 52 may access a file server or some other data source accessible in a network (such as the Internet), providing the type, version, manufacture or other data identifying the mobile device 18A to the file server to retrieve various aspects of this speaker characteristic data.

Initially, as described above, a user or other operator of the mobile device 18A interfaces with the control unit 40 to execute the collaborative sound system application 42. The control unit 40, in response to this user input, executes the collaborative sound system application 42. Upon executing the collaborative sound system application 42, the user may interface with the collaborative sound system application 42 (often via a touch display that presents a graphical user interface, which is not shown in the example of FIG. 2 for ease of illustration purposes) to register the mobile device 18A with the headend device 14, assuming the collaborative sound system application 42 may locate the headend device 14. If unable to locate the headend device 14, the collaborative sound system application 42 may help the user resolve any difficulties with locating the headend device 14, potentially providing troubleshooting tips to ensure, for example, that both the headend device 14 and the mobile device 18A are connected to the same wireless network or PAN.

In any event, assuming the collaborative sound system application 42 successfully locates the headend device 14 and registers the mobile device 18A with the headend device 14, the collaborative sound system application 42 may invoke the data collection engine 46 to retrieve the mobile device data 60. In invoking the data collection engine 46, the location module 48 may attempt to determine the location of the mobile device 18A relative to the headend device 14, possibly collaborating with the location module 38 using the tone 61 to enable the headend device 14 to resolve the location of the mobile device 18A relative to the headend device 14 in the manner described above.

The tone 61, as noted above, may be of a given frequency so as to distinguish the mobile device 18A from other ones of the mobile devices 18B-18N participating in collaborative surround sound system 10 that may also be attempting to collaborate with the location module 38 to determine their respective locations relative to the headend device 14. In other words, the headend device 14 may associate the mobile device 18A with the tone 61 having a first frequency, the mobile device 18B with a tone having a second different frequency, the mobile device 18C with a tone having a third different frequency, and so on. In this way, the headend device 14 may concurrently locate multiple ones of the mobile devices 18 at the same time rather than sequentially locate each of the mobile devices 18.

The power module 50 and the speaker module 52 may collect power consumption data and speaker characteristic data in the manner described above. The data collection engine 46 may aggregate this data forming the mobile device data 60. The data collection engine 46 may generate the mobile device data 60 so that the mobile device data 60 specifies one or more of a location of the mobile device 18A (if possible), a frequency response of the speaker 20A, a maximum allowable sound reproduction level of the speaker 20A, a battery status of the battery included within and powering the mobile device 18A, a synchronization status of the mobile device 18A, and a headphone status of the mobile device 18A (e.g., whether a headphone jack is currently in use preventing use of the speaker 20A). The data collection engine 46 then transmits this mobile device data 60 to the data retrieval engine 32 executed by the control unit 30 of the headend device 14.

The data retrieval engine 32 may parse this mobile device data 60 to provide the power consumption data to the power analysis module 34. The power analysis module 34 may, as described above, process this power consumption data to generate the refined power data 62. The data retrieval engine 32 may also invoke the location module 38 to determine the location of the mobile device 18A relative to the headend device 14 in the manner described above. The data retrieval engine 32 may then update the mobile device data 60 to include the determined location (if necessary) and refined power data 62, passing this updated mobile device data 60 to the audio rendering engine 36.

The audio rendering engine 36 may then render the source audio data 37 based on the updated mobile device data 64. The audio rendering engine 36 may then configure the collaborative surround sound system 10 to utilize the speaker 20A of the mobile device 18 as one or more virtual speakers of the collaborative surround sound system 10. The audio rendering engine 36 may also render audio signals 66 from the source audio data 37 such that, when the speaker 20A of the mobile device 18A plays the rendered audio signals 66, the audio playback of the rendered audio signals 66 appears to originate from the one or more virtual speakers of the collaborative surround sound system 10 which again often appear to be placed in a location different than the determined location of at least one of the mobile devices 18, such as the mobile devices 18A.

To illustrate, the audio rendering engine 36 may identify speaker sectors at which each of the virtual speakers of the collaborative surround sound system 10 are to appear to originate the source audio data 37. When rendering the source audio data 37, the audio rendering engine 36 may then render audio signals 66 from the source audio data 37 such that, when the rendered audio signals 66 are played by the speakers 20 of the mobile devices 18, the audio playback of the rendered audio signals 66 appears to originate from the virtual speakers of the collaborative surround sound system 10 in a location within the corresponding identified one of the speaker sectors.

In order to render source audio data 37 in this manner, the audio rendering engine 36 may configure an audio pre-processing function by which to render the source audio data 37 based on the location of one of the mobile devices 18, e.g., the mobile device 18A, so as to avoid prompting a user to move the mobile device 18A. Avoiding prompting a user to move a device may be necessary in some instances, such as after playback of audio data has started, given that moving the mobile device may disrupt other listeners in the room. The audio rendering engine 36 may then use the configured audio pre-processing function when rendering at least a portion of source audio data 37 to control playback of the source audio data in such a manner as to accommodate the location of the mobile device 18A.

Additionally, the audio rendering engine 36 may render the source audio data 37 based on other aspects of the mobile device data 60. For example, the audio rendering engine 36 may configure an audio pre-processing function for use when rendering the source audio data 37 based on the one or more speaker characteristics (so as to accommodate a frequency range of the speaker 20A of the mobile device 18A for example or maximum volume of the speaker 20A of the mobile device 18A, as another example). The audio rendering engine 36 may then render at least a portion of source audio data 37 based on the configured audio pre-processing function to control playback of the rendered audio signals 66 by the speaker 20A of the mobile device 18A.

The audio rendering engine 36 may then send or otherwise transmit rendered audio signals 66 or a portion thereof to the mobile devices 18.

Figure 3A:
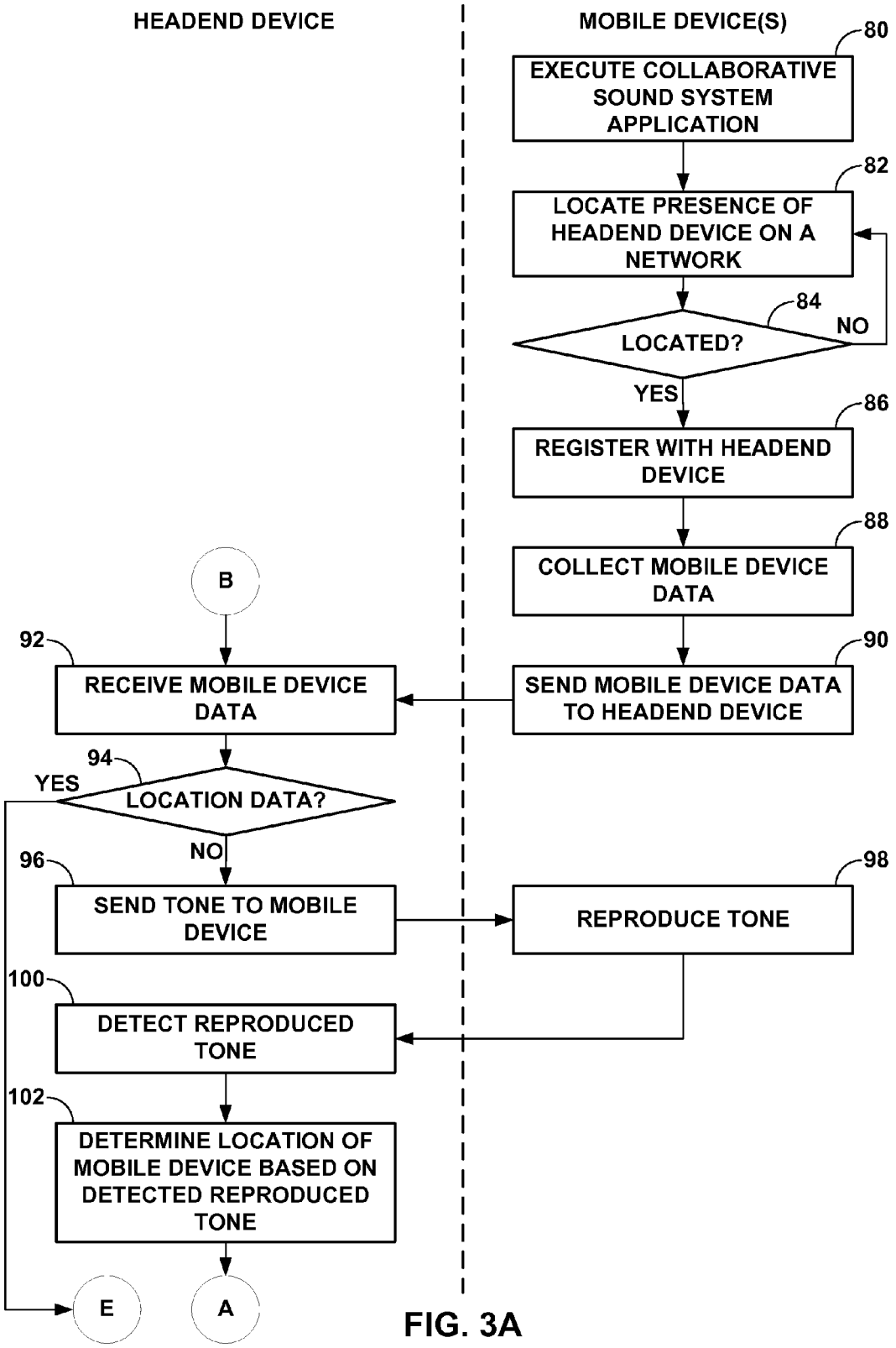
FIGS. 3A-3C are flowcharts illustrating example operation of a headend device and mobile devices in performing the collaborative surround sound system techniques described in this disclosure.
Figure 3B:
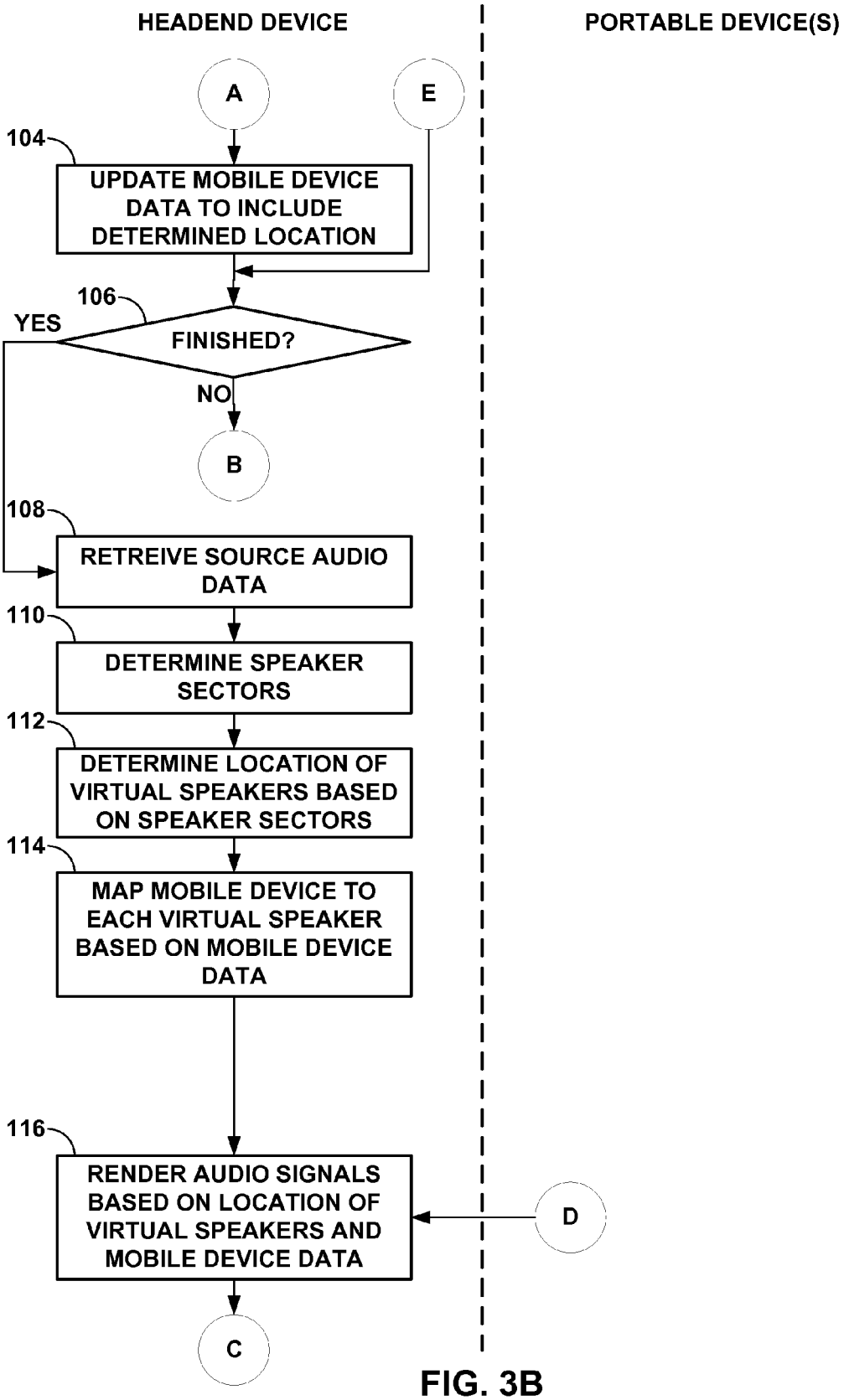
Figure 3C:
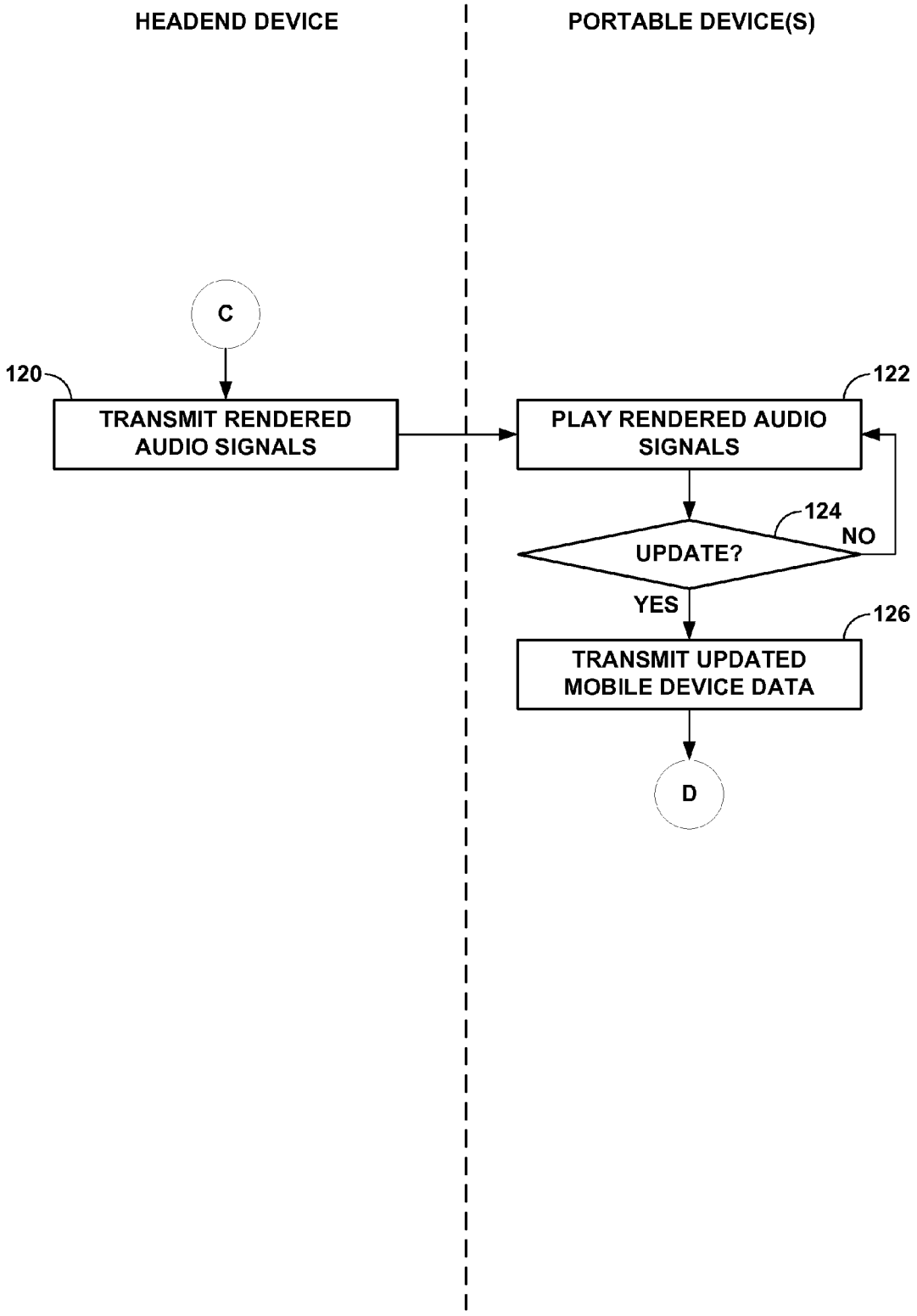

FIGS. 3A-3C are flowcharts illustrating example operation of the headend device 14 and the mobile devices 18 in performing the collaborative surround sound system techniques described in this disclosure. While described below with respect to a particular one of the mobile devices 18, i.e., the mobile device 18A in the examples of FIGS. 2 and 3A-3C, the techniques may be performed by the mobile devices 18B-18N in a manner similar to that described herein with respect to the mobile device 18A.

Initially, the control unit 40 of the mobile device 18A may execute the collaborative sound system application 42 (80). The collaborative sound system application 42 may first attempt to locate the presence of the headend device 14 on a wireless network (82). If the collaborative sound system application 42 is not able to locate the headend device 14 on the network ("NO" 84), the mobile device 18A may continue to attempt to locate the headend device 14 on the network, while also potentially presenting troubleshooting tips to assist the user in locating the headend device 14 (82). However, if the collaborative sound system application 42 locates the headend device 14 ("YES" 84), the collaborative sound system application 42 may establish a session 22A and register with the headend device 14 via the session 22A (86), effectively enabling the headend device 14 to identify the mobile device 18A as a device that includes a speaker 20A and is able to participate in the collaborative surround sound system 10.

After registering with the headend device 14, the collaborative sound system application 42 may invoke the data collection engine 46, which collects the mobile device data 60 in the manner described above (88). The data collection engine 46 may then send the mobile device data 60 to the headend device 14 (90). The data retrieval engine 32 of the headend device 14 receives the mobile device data 60 (92) and determines whether this mobile device data 60 includes location data specifying a location of the mobile device 18A relative to the headend device 14 (94). If the location data is insufficient to enable the headend device 14 to accurately locate the mobile device 18A (such as GPS data that is only accurate to within 30 feet) or if location data is not present in the mobile device data 60 ("NO" 94), the data retrieval engine 32 may invoke the location module 38, which interfaces with the location module 48 of the data collection engine 46 invoked by the collaborative sound system application 42 to send the tone 61 to the location module 48 of the mobile device 18A (96). The location module 48 of the mobile device 18A then passes this tone 61 to the audio playback module 44, which interfaces with the speaker 20A to reproduce the tone 61 (98).

Meanwhile, the location module 38 of the headend device 14 may, after sending the tone 61, interface with a microphone to detect the reproduction of the tone 61 by the speaker 20A (100). The location module 38 of the headend device 14 may then determine the location of the mobile device 18A based on detected reproduction of the tone 61 (102). After determining the location of the mobile device 18A using the tone 61, the data retrieval module 32 of the headend device 18 may update the mobile device data 60 to include the determined location, thereby generating the updated mobile device data 64 (FIG. 3B, 104).

If the data retrieval module 32 determines that location data is present in the mobile device data 60 (or that the location data is sufficiently accurate to enable the headend device 14 to locate the mobile device 18A with respect to the headend device 14) or after generating the updated mobile device data 64 to include the determined location, the data retrieval module 32 may determine whether it has finished retrieving the mobile device data 60 from each of the mobile devices 18 registered with the headend device 14 (106). If the data retrieval module 32 of the headend device 14 is not finished retrieving the mobile device data 60 from each of the mobile devices 18 ("NO" 106), the data retrieval module 32 continues to retrieve the mobile device data 60 and generate the updated mobile device data 64 in the manner described above (92-106). However, if the data retrieval module 32 determines that it has finished collecting the mobile device data 60 and generating the updated mobile device data 64 ("YES" 106), the data retrieval module 32 passes the updated mobile device data 64 to the audio rendering engine 36.

The audio rendering engine 36 may, in response to receiving this updated mobile device data 64, retrieve the source audio data 37 (108). The audio rendering engine 36 may, when rendering the source audio data 37, first determine speaker sectors that represent sectors at which speakers should be placed to accommodate playback of the multichannel source audio data 37 (110). For example, 5.1 channel source audio data includes a front left channel, a center channel, a front right channel, a surround left channel, a surround right channel and a subwoofer channel. The subwoofer channel is not directional or worth considering given that low frequencies typically provide sufficient impact regardless of the location of the subwoofer with respect to the headend device. The other five-channels, however, may however correspond to specific location so as to provide the best sound stage for immersive audio playback. The audio rendering engine 36 may interface, in some examples, with the location module 38 to derive the boundaries of the room, whereby the location module 38 may cause one or more of the speakers 16 and/or the speakers 20 to emit tones or sounds so as to identify the location of walls, people, furniture, etc. Based on this room or object location information, the audio rendering engine 36 may determine speaker sectors for each of the front left speaker, center speaker, front right speaker, surround left speaker and surround right speaker.

Based on these speaker sectors, the audio rendering engine 36 may determine a location of virtual speakers of the collaborative surround sound system 10 (112). That is, the audio rendering engine 36 may place virtual speakers within each of the speaker sectors often at optimal or near optimal locations relative to the room or object location information. The audio rendering engine 36 may then map mobile devices 18 to each virtual speaker based on the mobile device data 18 (114).

For example, the audio rendering engine 36 may first consider the location of each of the mobile devices 18 specified in the updated mobile device data 60, mapping those devices to virtual speakers having a virtual location closest to the determined location of the mobile devices 18. The audio rendering engine 36 may determine whether or not to map more than one of the mobile devices 18 to a virtual speaker based on how close currently assigned ones of mobile devices 18 are to the location of the virtual speaker. Moreover, the audio rendering engine 36 may determine to map two or more of the mobile devices 18 to the same virtual speaker when the refined power data 62 associated with one of the two or more the mobile devices 18 is insufficient to playback the source audio data 37 in its entirety, as described above. The audio rendering engine 36 may also map these mobile devices 18 based on other aspects of the mobile device data 60, including the speaker characteristics, again as described above.

The audio rendering engine 36 may then render audio signals from the source audio data 37 in the manner described above for each of the speakers 16 and speakers 20, effectively rendering the audio signals based on the location of the virtual speakers and/or the mobile device data 60 (116). In other words, the audio rendering engine 36 may then instantiate or otherwise define pre-processing functions to render source audio data 37, as described in more detail above. In this way, the audio rendering engine 36 may render or otherwise process the source audio data 37 based on the location of virtual speakers and the mobile device data 60. As noted above, the audio rendering engine 36 may consider the mobile device data 60 from each of the mobile devices 18 in the aggregate or as a whole when processing this audio data, yet transmit separate audio signals rendered from the audio source data 60 to each of the mobile devices 18. Accordingly, the audio rendering engine 36 transmits the rendered audio signals 66 to the mobile devices 18 (FIG. 3C, 120).

In response to receiving this rendered audio signals 66, the collaborative sound system application 42 interfaces with the audio playback module 44, which in turn interfaces with the speaker 20A to play the rendered audio signals 66 (122). As noted above, the collaborative sound system application 42 may periodically invoke the data collection engine 46 to determine whether any of the mobile device data 60 has changed or been updated (124). If the mobile device data 60 has not changed ("NO" 124), the mobile device 18A continues to play the rendered audio signals 66 (122). However, if the mobile device data 60 has changed or been updated ("YES" 124), the data collection engine 46 may transmit this changed the mobile device data 60 to the data retrieval engine 32 of the headend device 14 (126).

The data retrieval engine 32 may pass this changed mobile device data to the audio rendering engine 36, which may modify the pre-processing functions for rendering the audio signals to which the mobile device 18A has been mapped via the virtual speaker construction based on the changed mobile device data 60. As is described in more detail below, the commonly updated or changed mobile device data 60 changes due to, as one example, changes in power consumption or because the mobile device 18A is pre-occupied with another task, such as a voice call that interrupts audio playback.

In some instances, the data retrieval engine 32 may determine that the mobile device data 60 has changed in the sense that the location module 38 of the data retrieval module 32 may detect a change in the location of the mobile device 18. In other words, the data retrieval module 32 may periodically invoke the location module 38 to determine the current location of the mobile devices 18 (or, alternatively, the location module 38 may continually monitor the location of the mobile devices 18). The location module 38 may then determine whether one or more of the mobile devices 18 have been moved, thereby enabling the audio rendering engine 36 to dynamically modify the pre-processing functions to accommodate ongoing changes in location of the mobile devices 18 (such as might happen, for example, if a user picks up the mobile device to view a text message and then sets the mobile device back down in a different location). Accordingly, the technique may be applicable in dynamic settings to potentially ensure that virtual speakers remain at least proximate to optimal locations during the entire playback even though the mobile devices 18 may be moved or relocated during playback.

Figure 4:
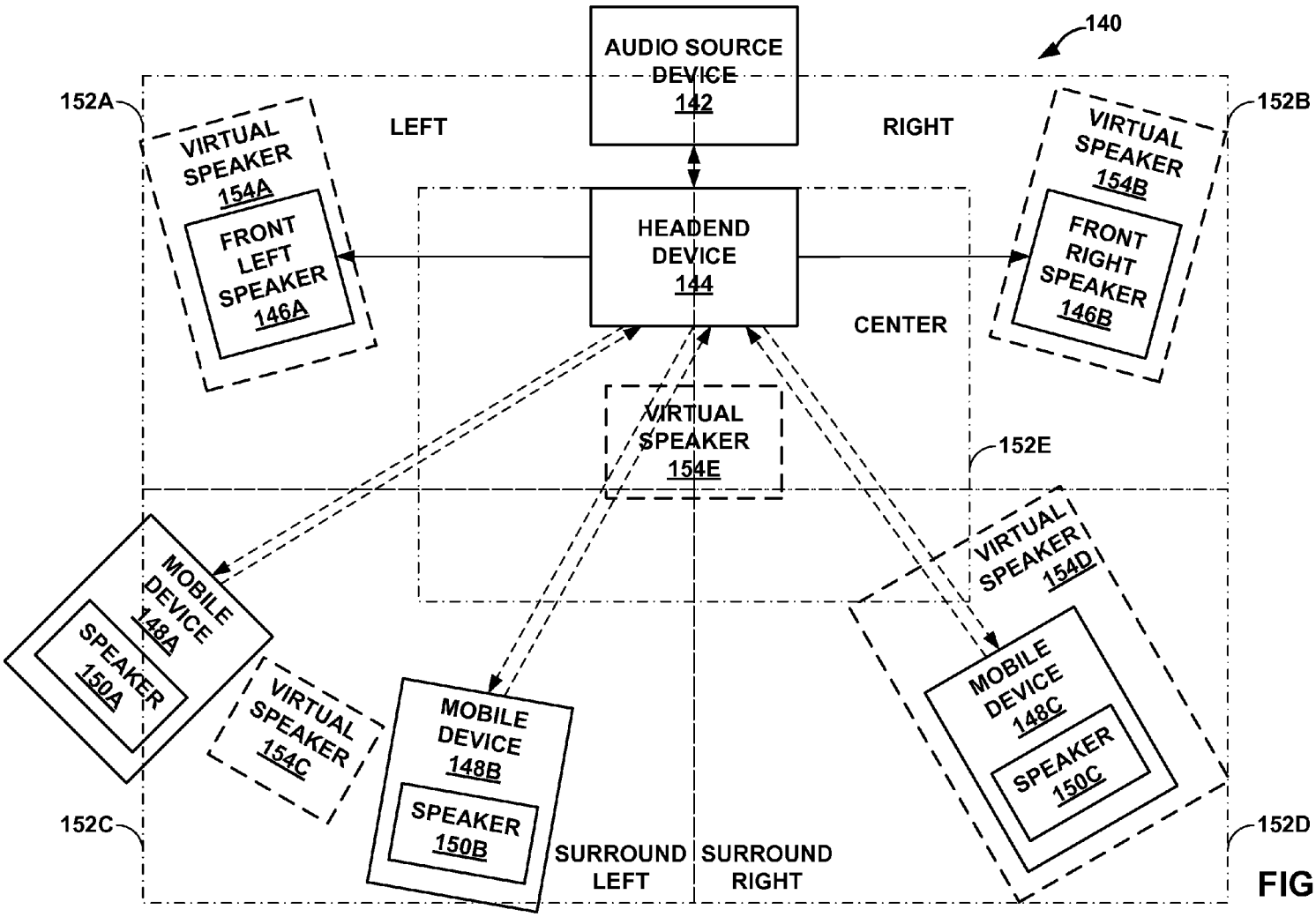
FIG. 4 is a block diagram illustrating further aspects of collaborative surround sound system formed in accordance with the techniques described in this disclosure.

FIG. 4 is a block diagram illustrating another collaborative surround sound system 140 formed in accordance with the techniques described in this disclosure. In the example of FIG. 4, the audio source device 142, the headend device 144, the front left speaker 146A, the front right speaker 146B and the mobile devices 148A-148C may be substantially similar to the audio source device 12, the headend device 14, the front left speaker 16A, the front right speaker 16B and the mobile devices 18A-18N described above, respectively, with respect to FIGS. 1, 2, 3A-3C.

As shown in the example of FIG. 4, the headend device 144 divides the room in which the collaborative surround sound system 140 operates in five separate speaker sectors 152A-152E ("sectors 152"). After determining these sectors 152, the headend device 144 may determine locations for the virtual speakers 154A-154E ("virtual speakers 154") for each of the sectors 152.

For each of the sectors 152A and 152B, the headend device 144 determines that the location of the virtual speakers 154A and 154B is close to or matches the location of the front left speaker 146A and the front right speaker 146B, respectively. For the sector 152C, the headend device 144 determines that the location of the virtual speaker 154C does not overlap with any of the mobile devices 148A-148C ("the mobile devices 148"). As a result, the headend device 144 searches the sector 152C to identify any of the mobile devices 148 that are located within or partially within the sector 152C. In performing this search, the headend device 144 determines that the mobile devices 148A and 148B are located within or at least partially within the sector 152C. The headend device 144 then maps these mobile devices 148A and 148B to the virtual speaker 154C. The headend device 144 then defines a first pre-processing function to render the surround left channel from the source audio data for playback by the mobile device 148A such that it appears as if the sound originates from the virtual speaker 154C. The headend device 144 also defines a second pre-processing function to render a second instance of the surround right channel from the source audio data for playback by the mobile device 148B such that it appears as if the sound originates from the virtual speaker 154C.

The headend device 144 may then consider the virtual speaker 154D and determines that the mobile device 148C is placed in a near optimal location within the sector 152D in that the location of the mobile device 148C overlaps (often, within a defined or configured threshold) the location of the virtual speaker 154D. The headend device 144 may define pre-processing functions for rendering the surround right channel based on other aspects of the mobile device data associated with the mobile device 148C, but may not have to define pre-processing functions to modify where this surround right channel will appear to originate.

The headend device 144 may then determine that there is no center speaker within the center speaker sector 152E that can support the virtual speaker 154E. As a result, the headend device 144 may define pre-processing functions that render the center channel from the source audio data to crossmix the center channel with both the front left channel and the front right channel so that the front left speaker 146A and the front right speaker 146B reproduce both of their respective front left channels and front right channels and the center channel. This pre-processing function may modify the center channel so that it appears as if the sound is being reproduced from the location of the virtual speaker 154E.

When defining the pre-processing functions that process the source audio data such that the source audio data appears to originate from a virtual speaker, such as the virtual speaker 154C and the virtual speaker 154E, when one or more of the speakers 150 are not located at the intended location of these virtual speakers, the headend device 144 may perform a constrained vector based dynamic amplitude panning aspect of the techniques described in this disclosure. Rather than perform vector based amplitude panning (VBAP) that is based only on pair-wise (two speakers for two-dimensional and three speakers for three dimensional) speakers, the headend device 144 may perform the constrained vector based dynamic amplitude panning techniques for three or more speakers. The constrained vector based dynamic amplitude panning techniques may be based on realistic constraints, thereby providing a higher degree of freedom in comparison to VBAP.

To illustrate, consider the following example, where three loudspeakers may be located in the left back corner (and thus in the surround left speaker sector 152C. In this example, three vectors may be defined, which may be denoted by $[l_{11}\ l_{12}]^T$, $[l_{21}\ l_{22}]^T$, $[l_{31}\ l_{32}]^T$, with a given $[p_1\ p_2]^T$, which represents the power and location of the virtual source. The headend device 144 may then solve the following equation $$\begin{bmatrix} p_1 \\ p_2 \end{bmatrix} = \begin{bmatrix} l_{11} l_{21} l_{31} \\ l_{12} l_{22} l_{32} \end{bmatrix} \begin{bmatrix} g_1 \\ g_2 \\ g_3 \end{bmatrix} (\vec{p} = L\vec{g}), \text{ where } \begin{bmatrix} g_1 \\ g_2 \\ g_3 \end{bmatrix}$$

is the unknown the headend device 144 may need to compute.

Solving for $$\begin{bmatrix} g_1 \\ g_2 \\ g_3 \end{bmatrix}$$

becomes a typical many unknowns problem, and a typical solution involves the headend device 144 determining a minimum norm solution. Assuming the headend device 144 solves this equation using an L2 norm, the headend device 144 solves the following equation:

$$\begin{bmatrix} g_1 \\ g_2 \\ g_3 \end{bmatrix} = \begin{bmatrix} l_{11} l_{21} l_{31} \\ l_{12} l_{22} l_{32} \end{bmatrix}^T \left[ \begin{bmatrix} l_{11} l_{21} l_{31} \\ l_{12} l_{22} l_{32} \end{bmatrix} \begin{bmatrix} l_{11} l_{21} l_{31} \\ l_{12} l_{22} l_{32} \end{bmatrix}^T \right]^{-1} \begin{bmatrix} p_1 \\ p_2 \end{bmatrix}$$

The headend device 144 may constrain $g_1$, $g_2$ and $g_3$ in one way by manipulating the vectors based on the constraint. The headend device 144 may then add a scalar power factor $a_1$, $a_2$, $a_3$, as in the following:

$$\begin{bmatrix} p_1 \\ p_2 \end{bmatrix} = \begin{bmatrix} a_1 l_{11} a_2 l_{21} a_3 l_{31} \\ a_1 l_{12} a_2 l_{22} a_3 l_{32} \end{bmatrix} \begin{bmatrix} g_1 \\ g_2 \\ g_3 \end{bmatrix}, \text{ and}$$

$$\begin{bmatrix} g_1 \\ g_2 \\ g_3 \end{bmatrix} = \begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

Note that when using an L2 norm solution, which is the solution providing proper gain for each of three speakers located in the surround left sector 152C, the headend device 144 may produce the virtually located loudspeaker and at the same time the power sum of the gain is minimum such that the headend device 144 may reasonably distribute the power consumption for all available three loudspeakers given the constraint on the intrinsic power consumption limit.

To illustrate, if the second device is running out of battery power, the headend device 144 may lower $a_2$ compared with other powers $a_1$ and $a_3$. As a more specific example, assume the headend device 144 determines three loudspeaker vectors $[1\ 0]^T$, $[1/\sqrt{2}\ 1/\sqrt{2}]^T$, $[1\ 0]^T$ and the headend device 144 is constrained in its solution to have $$\begin{bmatrix} p_1 \\ p_2 \end{bmatrix} = \begin{bmatrix} 1 \\ 1 \end{bmatrix}.$$

If there is no constraint meaning $a_1=a_2=a_3=1$, then $$\begin{bmatrix} g_1 \\ g_2 \\ g_3 \end{bmatrix} = \begin{bmatrix} 0.5 \\ 0.707 \\ 0.5 \end{bmatrix}.$$

However, if for some reason, such as battery or intrinsic maximum loudness per loudspeaker, the headend device 144 may need to lower the volume of the second loudspeaker, resulting in the second vector being lowered down by $$a_2 = \sqrt{2}/10, \text{ then } \begin{bmatrix} g_1 \\ g_2 \\ g_3 \end{bmatrix} = \begin{bmatrix} 0.980 \\ 0.196 \\ 0.980 \end{bmatrix}.$$

In this example, the headend device 144 may reduce gain for the second loudspeaker, yet the virtual image remains in the same or nearly the same location.

These techniques described above may be generalized as follows:

1. If the headend device 144 determines that one or more of the speakers have a frequency dependent constraint, then headend device may define the equation above so that it is dependent $$\begin{bmatrix} g_{1,k} \\ g_{2,k} \\ g_{3,k} \end{bmatrix},$$

where k is frequency index, via any kind of filter bank analysis and synthesis including a short-time Fourier transform.

2. The headend device 144 may extend this into arbitrary N 2 loudspeaker case, by allocating the vector based on the detected location.
3. The headend device 144 may arbitrarily group any combination with proper power gain constraint; where this power gain constraint may be overlapped or non-overlapped. In some instances, the headend device 144 can use all the loudspeakers at the same time to produce five or more different location-based sounds. In some examples, the headend device 144 may group the loud speakers in each designated region, e.g. the five speaker sectors 152 shown in FIG. 4. If there is only one in one region, the headend device 144 may extend the group for that region to the next region.

4. If some devices are moving or just registered with the collaborative surround sound system 140, the headend device 144 may update (change or add) corresponding basis vectors and compute the gain for each speaker, which will likely be adjusted.
5. While described above with respect to the L2 norm, the headend device 144 may utilize different norms other than the L2 norm, to have this minimum norm solution. For example, when using an L0 norm, the headend device 144 may calculate a sparse gain solution, meaning a small gain loudspeaker for L2 norm case will become zero gain loudspeaker.
6. The power constraint added minimum norm solution presented above is a specific way of implementing the constraint optimization problem. However, any kind of constrained convex optimization method can be combined with the problem: $\min_g \|\bar{p}_k - L_k \bar{g}_k\|$ s.t. $g_{1,k} \leq g_{1,k}^0$, $g_{2,k} \leq g_{2,k}^0, \ldots, g_{N,k} \leq g_{N,k}^0$.

In this way, the headend device 144 may identify, for the mobile device 150A participating in the collaborative surround sound system 140, a specified location of the virtual speaker 154C of the collaborative surround sound system 140. The headend device 144 may then determine a constraint that impacts playback of multi-channel audio data by the mobile device, such as an expected power duration. The headend device 144 may then perform the above described constrained vector based dynamic amplitude panning with respect to the source audio data 37 using the determined constraint to render audio signals 66 in a manner that reduces the impact of the determined constraint on playback of the rendered audio signals 66 by the mobile device 150A.

In addition, the headend device 144 may, when determining the constraint, determine an expected power duration that indicates an expected duration that the mobile device will have sufficient power to playback the source audio data 37. The headend device 144 may then determine a source audio duration that indicates a playback duration of the source audio data 37. When the source audio duration exceeds the expected power duration, the headend device 144 may determine the expected power duration as the constraint.

Moreover, in some instances, when performing the constrained vector based dynamic amplitude panning, the headend device 144 may perform the constrained vector based dynamic amplitude panning with respect to the source audio data 37 using the determined expected power duration as the constraint to render audio signals 66 such that an expected power duration to playback rendered audio signals 66 is less than the source audio duration.

In some instances, when determining the constraint, the headend device 144 may determine a frequency dependent constraint. When performing the constrained vector based dynamic amplitude panning, the headend device 144 may perform the constrained vector based dynamic amplitude panning with respect to the source audio data 37 using the determined frequency constraint to render the audio signals 66 such that an expected power duration to playback the rendered audio signals 66 by the mobile device 150A, as one example, is less than a source audio duration indicating a playback duration of the source audio data 37.

In some instances, when performing the constrained vector based dynamic amplitude panning, the headend device 144 may consider a plurality of mobile devices that support one of the plurality of virtual speakers. As noted above, in some instances, the headend device 144 may perform this aspect of the techniques with respect to three mobile devices. When performing the constrained vector based dynamic amplitude panning with respect to the source audio data 37 using the expected power duration as the constraint and assuming three mobile devices support a single virtual speaker, the headend device 144 may first compute volume gains $g_1$, $g_2$ and $g_3$ for the first mobile device, the second mobile device and the third mobile device, respectively, in accordance with the following equation:

$$\begin{bmatrix} g_1 \\ g_2 \\ g_3 \end{bmatrix} = \begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

As noted above, $a_1$, $a_2$ and $a_3$ denote a scalar power factor for the first mobile device, a scalar power factor for the second mobile device and a scalar power factor for the third mobile device. $l_{11}$, $l_{12}$ denote a vector identifying the location of the first mobile device relative to the headend device 144. $l_{21}$, $l_{22}$ denote a vector identifying the location of the second mobile device relative to the headend device 144. $l_{31}$, $l_{32}$ denote a vector identifying the location of the third mobile device relative to the headend device 144. $p_1$, $p_2$ denote a vector identifying the specified location relative to the headend device 144 of one of the plurality of virtual speaker supported by the first mobile device, the second mobile device and the third mobile device.

Figure 5:
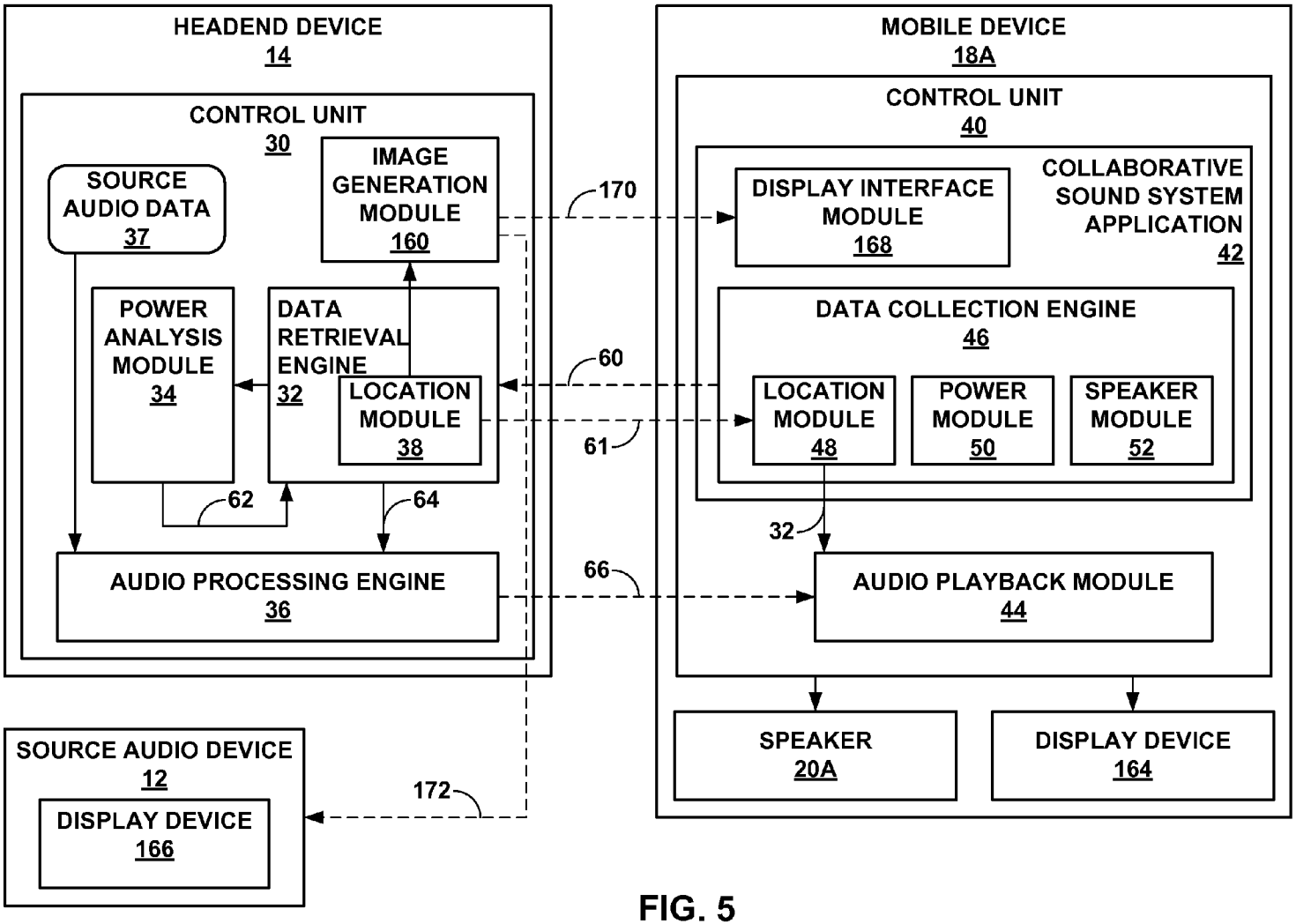
FIG. 5 is a block diagram illustrating another aspect of the collaborative surround sound system of FIG. 1 in more detail.

FIG. 5 is a block diagram illustrating a portion of the collaborative surround sound system 10 of FIG. 1 in more detail. The portion of the collaborative surround sound system 10 shown in FIG. 2 includes the headend device 14 and the mobile device 18A. While described below with respect to a single mobile device, i.e., the mobile device 18A in the example of FIG. 5, for ease of illustration purposes, the techniques may be implemented with respect to multiple mobile devices, e.g., the mobile devices 18 shown in the example of FIG. 1.

As shown in the example of FIG. 5, the headend device 14 includes the same components, units and modules described above with respect to and shown in the example of FIG. 2, while also including an additional image generation module 160. The image generation module 160 represents a module or unit that is configured to generate one or more images 170 for display via a display device 164 of mobile device 18A and one or more images 172 for display via a display device 166 of source audio device 12. The images 170 may represent any one or more images that may specify a direction or location that the mobile device 18A is to be moved or placed. Likewise, the images 172 may represent one or more images indicating a current location of the mobile device 18A and a desired or intended location of the mobile device 18A. The images 172 may also specify a direction that the mobile device 18A is to be moved.

Likewise, the mobile device 18A includes the same component, units and modules described above with respect to and shown in the example of FIG. 2, while also including the display interface module 168. The display interface module 168 may represent a unit or module of the collaborative sound system application 42 that is configured to interface with the display device 164. The display interface module 168 may interface with the display device 164 to transmit or otherwise cause the display device 164 to display the images 170.

Initially, as described above, a user or other operator of the mobile device 18A interfaces with the control unit 40 to execute the collaborative sound system application 42. The control unit 40, in response to this user input, executes the collaborative sound system application 42. Upon executing the collaborative sound system application 42, the user may interface with the collaborative sound system application 42 (often via a touch display that presents a graphical user interface, which is not shown in the example of FIG. 2 for ease of illustration purposes) to register the mobile device 18A with the headend device 14, assuming the collaborative sound system application 42 may locate the headend device 14. If unable to locate the headend device 14, the collaborative sound system application 42 may help the user resolve any difficulties with locating the headend device 14, potentially providing troubleshooting tips to ensure, for example, that both the headend device 14 and the mobile device 18A are connected to the same wireless network or PAN.

In any event, assuming the collaborative sound system application 42 successfully locates the headend device 14 and registers the mobile device 18A with the headend device 14, the collaborative sound system application 42 may invoke the data collection engine 46 to retrieve the mobile device data 60. In invoking the data collection engine 46, the location module 48 may attempt to determine the location of the mobile device 18A relative to the headend device 14, possibly collaborating with the location module 38 using the tone 61 to enable the headend device 14 to resolve the location of the mobile device 18A relative to the headend device 14 in the manner described above.

The tone 61, as noted above, may be of a given frequency so as to distinguish the mobile device 18A from the other mobile devices 18B-18N participating in the collaborative surround sound system 10 that may also be attempting to collaborate with the location module 38 to determine their respective locations relative to the headend device 14. In other words, the headend device 14 may associate the mobile device 18A with the tone 61 having a first frequency, the mobile device 18B with a tone having a second different frequency, the mobile device 18C with a tone having a third different frequency, and so on. In this manner, the headend device 14 may concurrently locate multiple ones of the mobile devices 18 at the same time rather than sequentially locate each of the mobile devices 18.

The power module 50 and the speaker module 52 may collect power consumption data and speaker characteristic data in the manner described above. The data collection engine 46 may aggregate this data forming the mobile device data 60. The data collection engine 46 may generate the mobile device data 60 that specifies one or more of a location of the mobile device 18A (if possible), a frequency response of the speaker 20A, a maximum allowable sound reproduction level of the speaker 20A, a battery status of the battery included within and powering the mobile device 18A, a synchronization status of the mobile device 18A, and a headphone status of the mobile device 18A (e.g., whether a headphone jack is currently in use preventing use of the speaker 20A). The data collection engine 46 then transmits this mobile device data 60 to the data retrieval engine 32 executed by the control unit 30 of the headend device 14.

The data retrieval engine 32 may parse this mobile device data 60 to provide the power consumption data to the power analysis module 34. The power analysis module 34 may, as described above, process this power consumption data to generate the refined power data 62. The data retrieval engine 32 may also invoke the location module 38 to determine the location of the mobile device 18A relative to the headend device 14 in the manner described above. The data retrieval engine 32 may then update the mobile device data 60 to include the determined location (if necessary) and the refined power data 62, passing this updated mobile device data 60 to the audio rendering engine 36.

The audio rendering engine 36 may then process the source audio data 37 based on the updated mobile device data 64. The audio rendering engine 36 may then configure the collaborative surround sound system 10 to utilize the speaker 20A of the mobile device 18A as one or more virtual speakers of the collaborative surround sound system 10. The audio rendering engine 36 may also render audio signals 66 from the source audio data 37 such that, when the speaker 20A of the mobile device 18A plays the rendered audio signals 66, the audio playback of the rendered audio signals 66 appears to originate from the one or more virtual speakers of the collaborative surround sound system 10, which often appears to be placed in a location different than the determined location of the mobile device 18A.

To illustrate, the audio rendering engine 36 may assign speaker sectors to a respective one of the one or more virtual speakers of the collaborative surround sound system 10 given the mobile device data 60 from one or more of mobile devices 18 that support the corresponding one or more of the virtual speakers. When rendering the source audio data 37, the audio rendering engine 36 may then render audio signals 66 from the source audio data 37 such that, when the rendered audio signals 66 are played by the speakers 20 of the mobile devices 18, the audio playback of the rendered audio signals 66 appears to originate from the virtual speakers of collaborative surround sound system 10, which again are often in a location within the corresponding identified one of the speaker sectors that is different than a location of at least one of the mobile devices 18.

In order to render source audio data 37 in this manner, the audio rendering engine 36 may configuring an audio preprocessing function by which to render source audio data 37 based on the location of one of the mobile devices 18, e.g., the mobile device 18A, so as to avoid prompting a user to move the mobile device 18A. While avoiding a user prompt to move a device may be necessary in some instances, such as after playback of audio signals 66 has started, when initially placing the mobile devices 18 around the room prior to playback, the headend device 14 may prompt the user, in certain instances, to move the mobile devices 18. The headend device 14 may determine that one or more of the mobile devices 18 need to be moved by analyzing the speaker sectors and determining that one or more speaker sectors do not have any mobile devices or other speakers present in the sector.

The headend device 14 may then determine whether any speaker sectors have two or more speakers and based on the updated mobile device data 64 identify which of these two or more speakers should be relocated to the empty speaker sector having none of the mobile devices 18 located within this speaker sector. The headend device 14 may consider the refined power data 62 when attempting to relocate one or more of the two or more speakers from one speaker sector to another, determining to relocate those of the two or more speakers having at least sufficient power as indicated by the refined power data 62 to playback rendered audio signals 66 in its entirety. If no speakers meet this power criteria, the headend device 14 may determine that two or more speakers from overloaded speaker sectors (which may refer to those speaker sectors having more than one speaker located in that sector) to the empty speaker sector (which may refer to a speaker sector for which no mobile devices or other speakers are present).

Upon determining which of the mobile devices 18 to relocate in the empty speaker sector and the location at which these mobile devices 18 are to be placed, the control unit 30 may invoke the image generation module 160. The location module 38 may provide the intended or desired location and the current location of those of the mobile devices 18 to be relocated to the image generation module 160. The image generation module 160 may then generate the images 170 and/or 172, transmitting these images 170 and/or 172 to the mobile device 18A and the source audio device 12, respectively. The mobile device 18A may then present the images 170 via the display device 164, while the source audio device 12 may present the images 172 via the display device 164. The image generation module 160 may continue to receive updates to the current location of the mobile devices 18 from the location module 38 and generate the images 170 and 172 displaying this updated current location. In this sense, the image generation module 160 may dynamically generate the images 170 and/or 172 that reflect the current movement of the mobile devices 18 relative to the headend unit 14 and the intended location. Once placed in the intended location, the image generation module 160 may generate the images 170 and/or 172 that indicate the mobile devices 18 have been placed in the intended or desired location, thereby facilitating configuration of the collaborative surround sound system 10. The images 170 and 172 are described in more detail below with respect to FIGS. 6A-6C and 7A-7C.

Additionally, the audio rendering engine 36 may render audio signals 66 from source audio data 37 based on other aspects of the mobile device data 60. For example, the audio rendering engine 36 may configure an audio pre-processing function by which to render source audio data 37 based on the one or more speaker characteristics (so as to accommodate a frequency range of the speaker 20A of the mobile device 18A, for example, or maximum volume of the speaker 20A of the mobile device 18A, as another example). The audio rendering engine 36 may then apply the configured audio pre-processing function to at least a portion of the source audio data 37 to control playback of rendered audio signals 66 by the speaker 20A of the mobile device 18A.

The audio rendering engine 36 may then send or otherwise transmit rendered audio signals 66 or a portion thereof to the mobile device 18A. The audio rendering engine 36 may map one or more of the mobile devices 18 to each channel of multi-channel source audio data 37 via the virtual speaker construction. That is, each of the mobile devices 18 is mapped to a different virtual speaker of the collaborative surround sound system 10. Each virtual speaker is in turn mapped to speaker sector, which may support one or more channels of the multi-channel source audio data 37. Accordingly, when transmitting the rendered audio signals 66, the audio rendering engine 36 may transmit the mapped channels of the rendered audio signals 66 to the corresponding one or more of the mobile devices 18 that are configured as the corresponding one or more virtual speakers of the collaborative surround sound system 10.

Throughout the discussion of the techniques described below with respect to FIGS. 6A-6C and 7A-7C, reference to channels may be as follows: a left channel may be denoted as "L", a right channel may be denoted as "R", a center channel may be denoted as "C", rear-left channel may be referred to as a "surround left channel" and may be denoted as "SL", and a rear-right channel may be referred to as a "surround right channel" and may be denoted as "SR." Again, the subwoofer channel is not illustrated in FIG. 1 as location of the subwoofer is not as important as the location of the other five channels in providing a good surround sound experience.

Figures 6A, 6B, 6C:
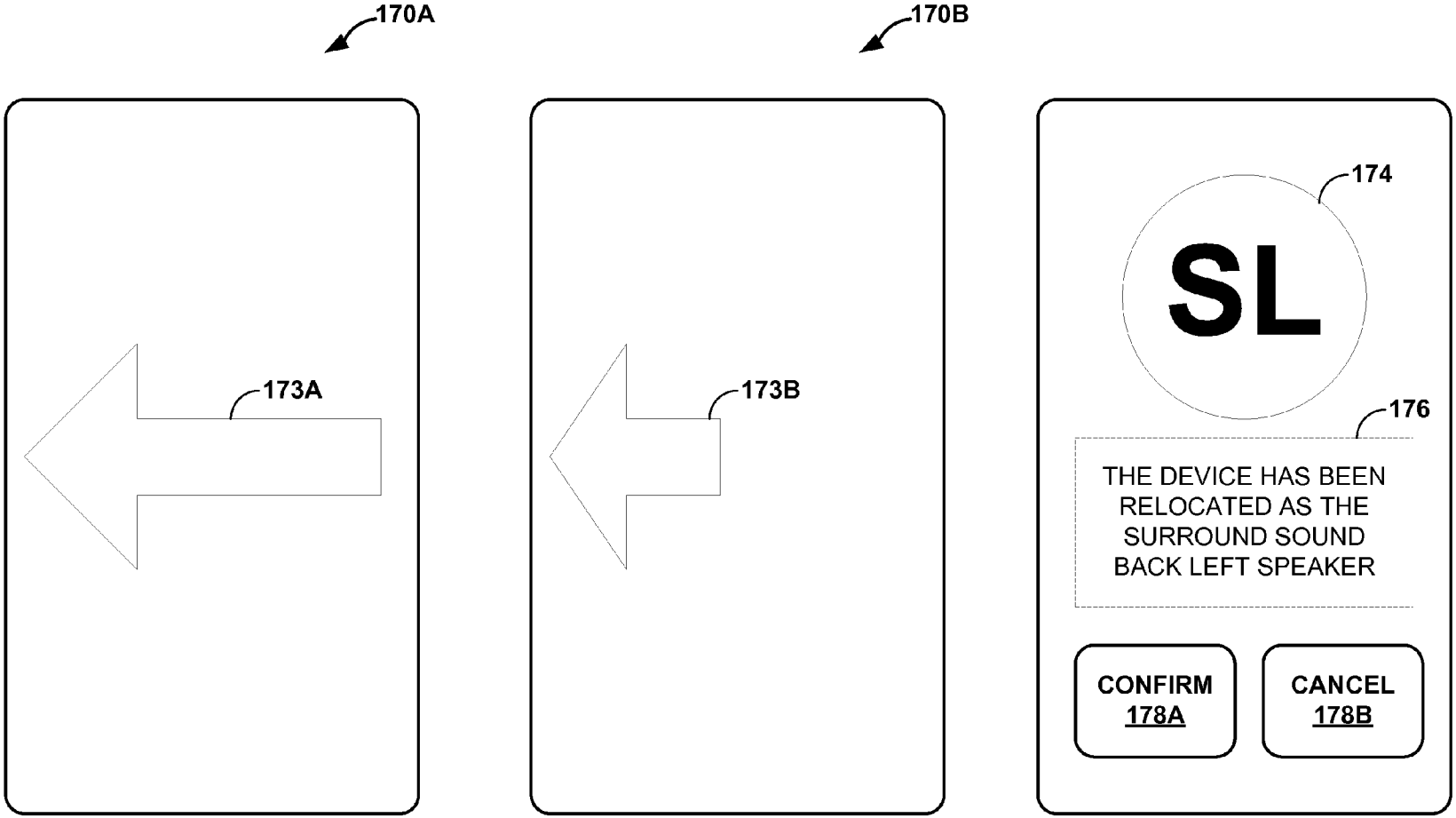
FIGS. 6A-6C are diagrams illustrating exemplary images in more detail as displayed by a mobile device in accordance with various aspects of the techniques described in this disclosure.

FIGS. 6A-6C are diagrams illustrating exemplary images 170A-170C of FIG. 5 in more detail as displayed by the mobile device 18A in accordance with various aspects of the techniques described in this disclosure. FIG. 6A is a diagram showing a the first image 172A, which includes an arrow 173A. The arrow 173A indicates a direction the mobile device 18A is to be moved to place the mobile device 18A in the intended or optimal location. The length of the arrow 173A may approximately indicate how far from the current location of the mobile device 18A is from the intended location.

FIG. 6B is a diagram illustrating a second image 170B, which includes a second arrow 173B. The arrow 173B, like the arrow 173A, may indicate a direction the mobile device 18A is to be moved to place the mobile device 18A in the intended or optimal location. The arrow 173B differs from the arrow 173A in that the arrow 173B has a shorter length, indicating that the mobile device 18A has moved closer to the intended location relative to the location of the mobile device 18A when the image 170A was presented. In this example, the image generation module 160 may generate the image 170B in response to the location module 38 providing an updated current location of the mobile device 18A.

FIG. 6C is a diagram illustrating a third image 170C, where images 170A-170C may be referred to as the images 170 (which are shown in the example of FIG. 5). The image 170C indicates that the mobile device 18A has been placed in the intended location of the surround left virtual speaker. The image 170C includes an indication 174 ("SL") that the mobile device 18A has been positioned in the intended location of the surround left virtual speaker. The image 170C also includes a text region 176 that indicates that the device has been relocated as the surround sound back left speaker, so that the user further understands that the mobile device 18 is properly positioned in the intended location to support the virtual surround sound speaker. The image 170C further includes two virtual buttons 178A and 178B that enable the user to confirm (button 178A) or cancel (button 178B) registering the mobile device 18A as participating to support the surround sound left virtual speaker of the collaborative surround sound system 10.

Figure 7A:
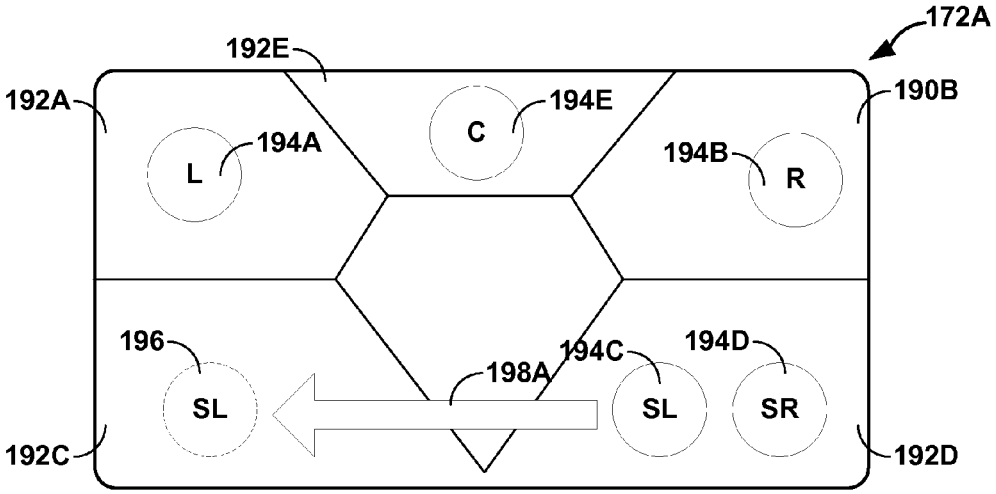
FIGS. 7A-7C are diagrams illustrating exemplary images in more detail as displayed by a device coupled to a headend device in accordance with various aspects of the techniques described in this disclosure.
Figure 7B:
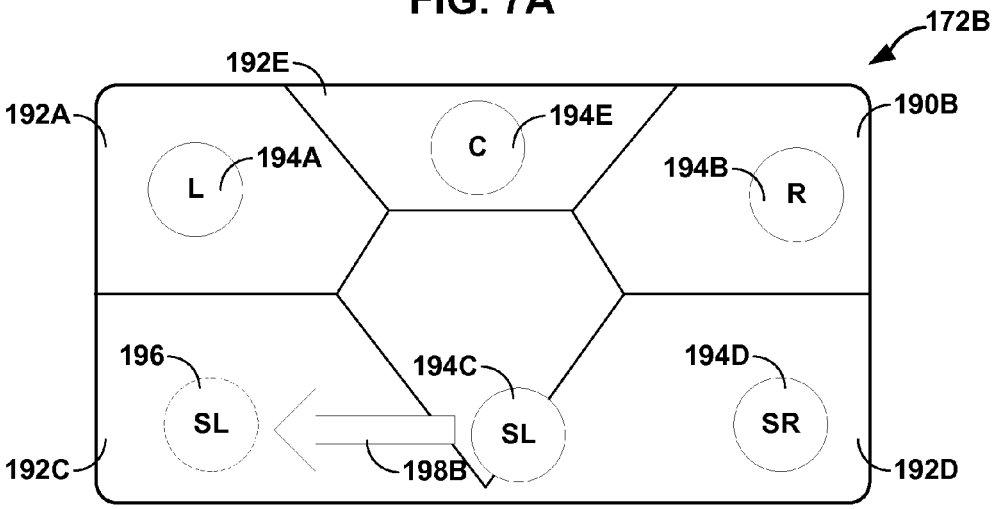
Figure 7C:
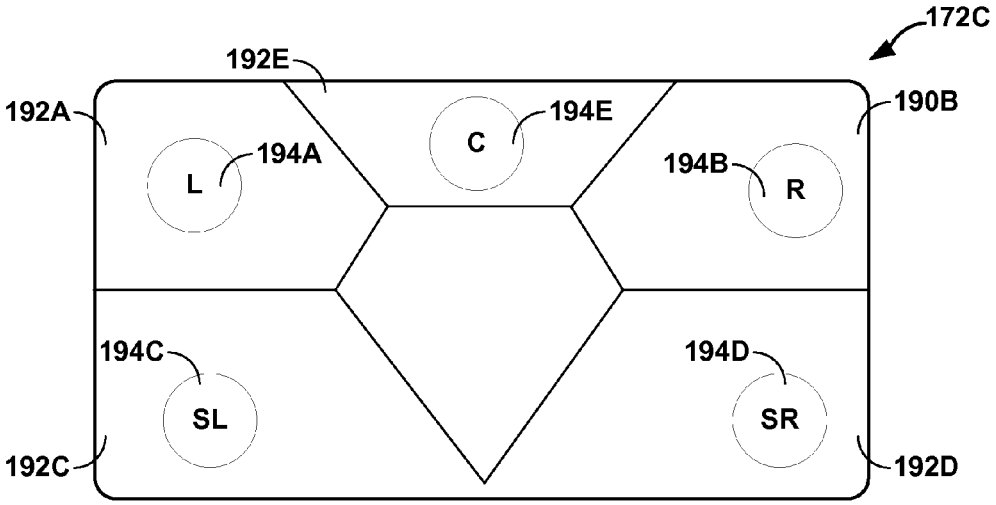

FIGS. 7A-7C are diagrams illustrating exemplary images 172A-172C of FIG. 5 in more detail as displayed by the source audio device 12 in accordance with various aspects of the techniques described in this disclosure. FIG. 7A is a diagram showing a first image 170A, which includes speaker sectors 192A-192E, speakers (which may represent mobile devices 18) 194A-194E, intended surround sound virtual speaker left indication 196 and an arrow 198A. The speaker sectors 192A-192E ("speaker sectors 192") may each represent a different speaker sector of a 5.1 surround sound format. While shown as including five speaker sectors, the techniques may be implemented with respect to any configuration of speaker sectors, including seven speaker sectors to accommodate a 7.1 surround sound format and emerging three-dimensional surround sound formats.

The speakers 194A-194E ("speakers 194") may represent the current location of the speakers 194, where the speakers 194 may represent the speakers 16 and the mobile devices 18 shown in the example of FIG. 1. When properly positioned, the speakers 194 may represent the intended location of virtual speakers. Upon detecting that one or more of the speakers 194 are not properly positioned to support one of the virtual speakers, the headend device 14 may generate the image 172A with the arrow 198A denoting that one or more of the speakers 194 are to be moved. In the example of FIG. 7A, the mobile device 18A represents the surround sound left (SL) speaker 194C, which has been positioned out of place in the surround right (SR) speaker sector 192D. Accordingly, the headend device 14 generates the image 172A with the arrow 198A indicating that the SL speaker 194C is to be moved to the intended SL position 196. The intended SL position 196 represents an intended position of the SL speaker 194C, where the arrow 198A points from the current location of the SL speaker 194C to the intended SL position 196. The headend device 14 may also generate above described image 170A for display on the mobile device 18A to further facilitate the re-location of the mobile device 18A.

FIG. 7B is a diagram illustrating a second image 172B, which is similar to image 172A except that image 172B includes a new arrow 198B with the current location of the SL speaker 194C having moved to the left. The arrow 198B, like arrow 198A, may indicate a direction the mobile device 18A is to be moved to place the mobile device 18A in the intended location. The arrow 198B differs from the arrow 198A in that the arrow 198B has a shorter length, indicating that the mobile device 18A has moved closer to the intended location relative to the location of the mobile device 18A when the image 172A was presented. In this example, the image generation module 160 may generate the image 172B in response to the location module 38 providing an updated current location of the mobile device 18A.

FIG. 7C is a diagram illustrating a third image 172C, where images 172A-172C may be referred to as the images 172 (which are shown in the example of FIG. 5). The image 172C indicates that the mobile device 18A has been placed in the intended location of the surround left virtual speaker. The image 170C indicates this proper placement by removing the intended location indication 196 and indicating that the SL speaker 194C is properly placed (removing the dashed lines of the SL indication 196 to be replaced with a solid lined SL speaker 194C). The image 172C may be generated and displayed in response to the user confirming, using the confirm button 178A of the image 170C, that the mobile device 18A is to participate in supporting the SL virtual speaker of the collaborative surround sound system 10.

Using the images 170 and/or 172, the user of the collaborative surround sound system may move the SL speaker of the collaborative surround sound system to the SL speaker sector. The headend device 14 may periodically update these images as described above to reflect the movement of the SL speaker within the room setup to facilitate the user's repositioning of the SL speaker. That is, the headend device 14 may cause the speaker to continuously emit the sound noted above, detect this sound, and update the location of this speaker relative to the other speakers within the image, where this updated image is then displayed. In this way, the techniques may promote adaptive configuration of the collaborative surround sound system to potentially achieve a more optimal surround sound speaker configuration that reproduces a more accurate sound stage for a more immersive surround sound experience.

Figure 8A:
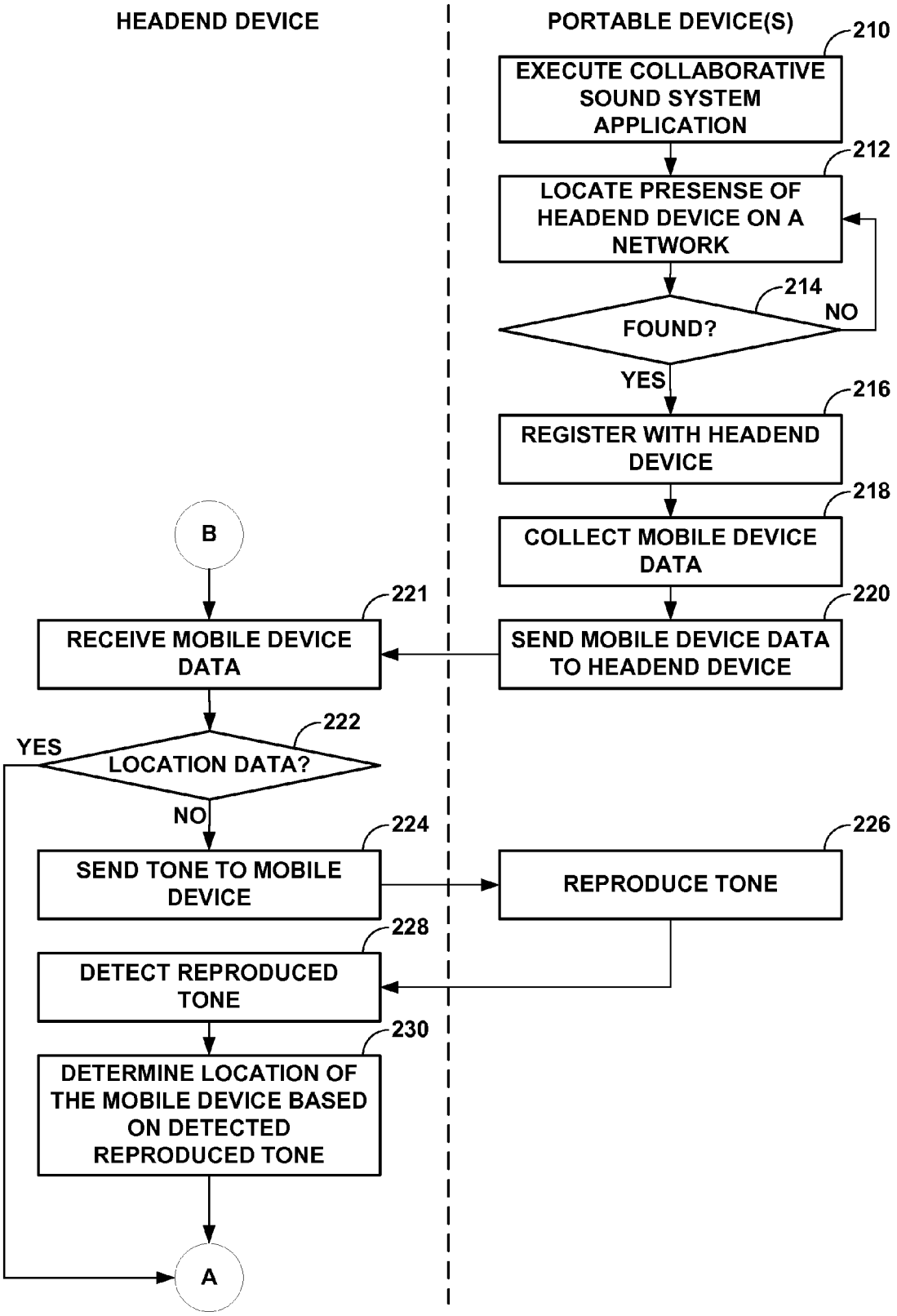
FIGS. 8A-8C are flowcharts illustrating example operation of a headend device and mobile devices in performing various aspects of the collaborative surround sound system techniques described in this disclosure.
Figure 8B:
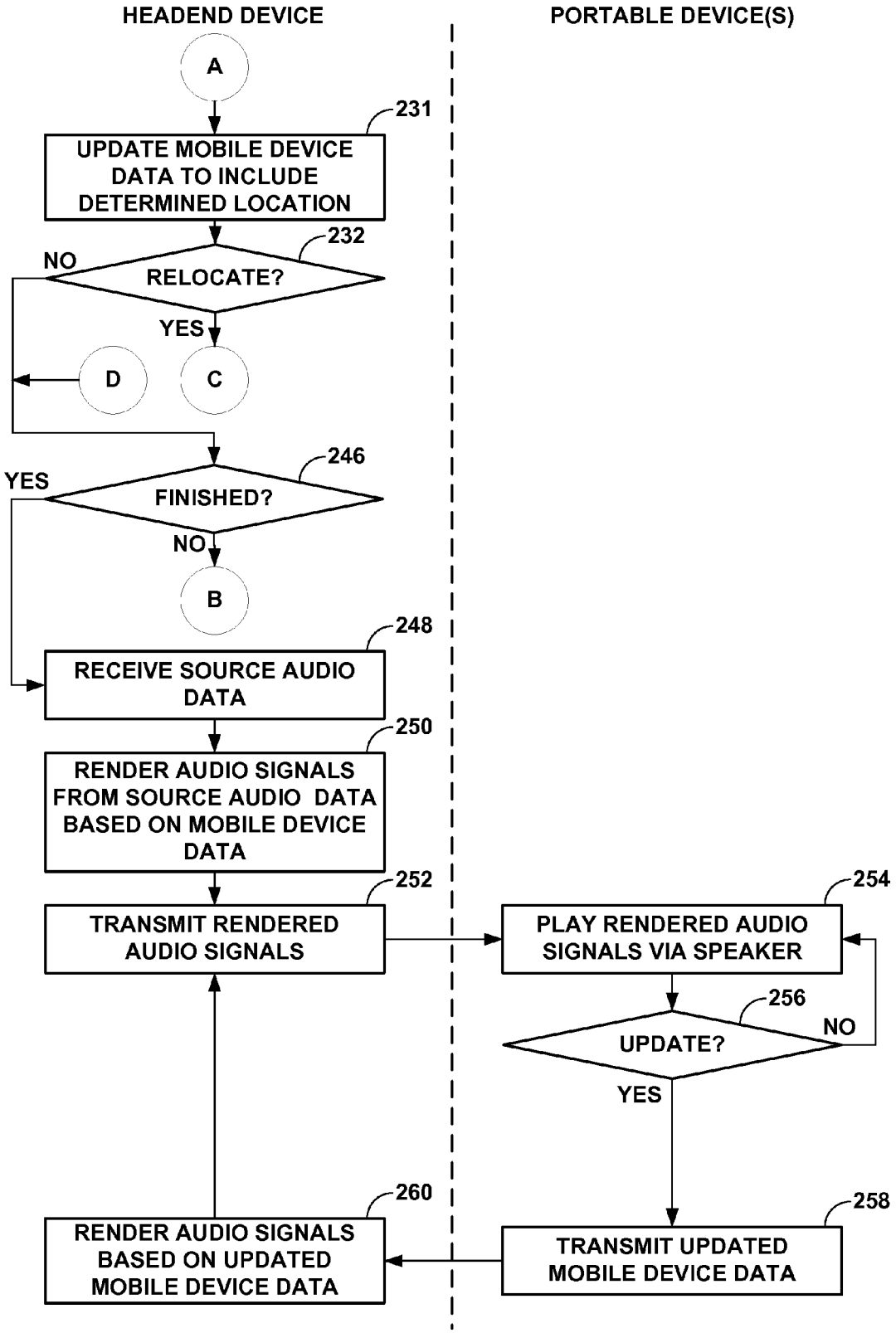
Figure 8C:
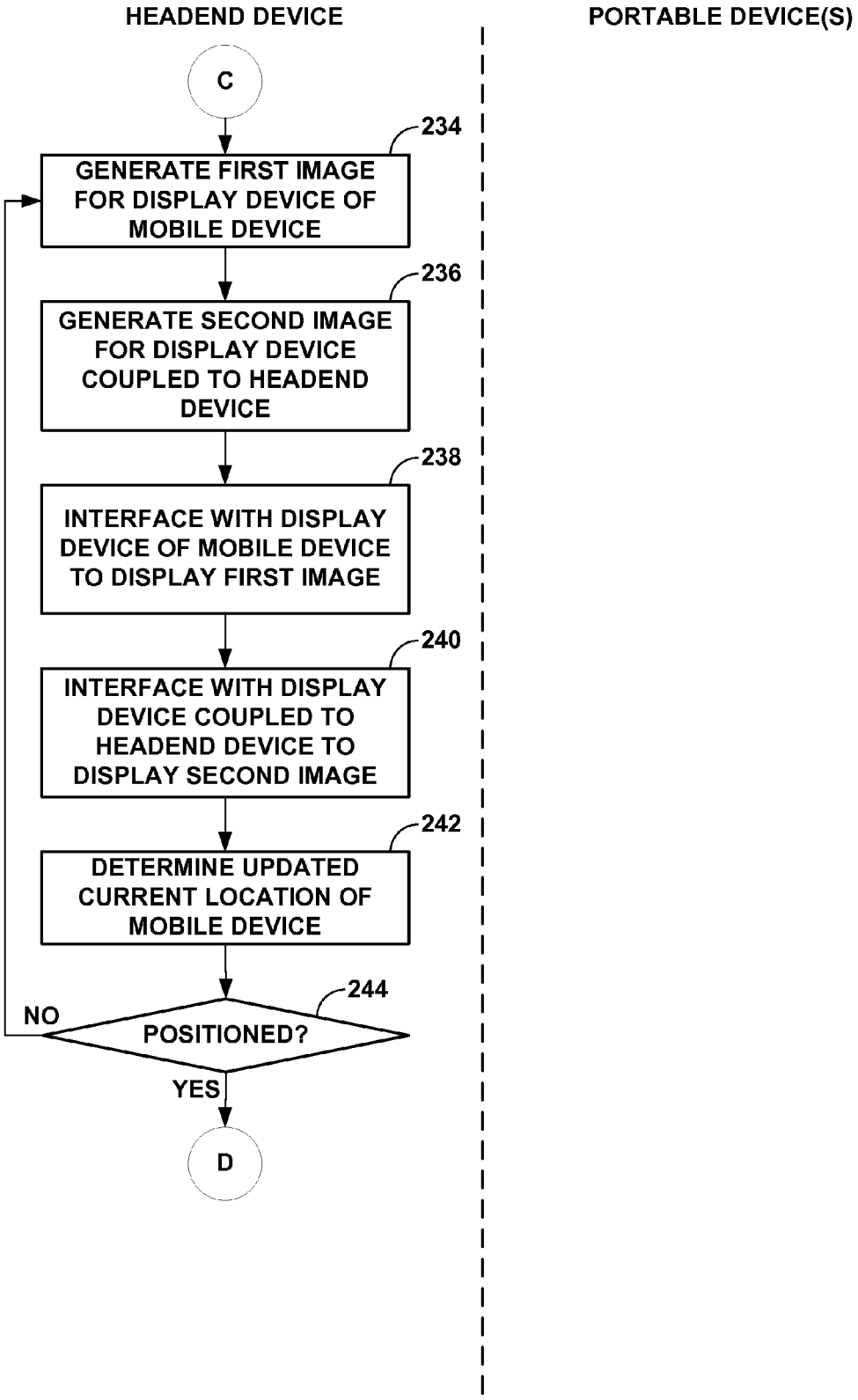

FIGS. 8A-8C are flowcharts illustrating example operation of the headend device 14 and the mobile devices 18 in performing various aspects of the collaborative surround sound system techniques described in this disclosure. While described below with respect to a particular one of the mobile devices 18, i.e., the mobile device 18A in the examples of FIG. 5, the techniques may be performed by the mobile devices 18B-18N in a manner similar to that described herein with respect to the mobile device 18A.

Initially, the control unit 40 of the mobile device 18A may execute the collaborative sound system application 42 (210). The collaborative sound system application 42 may first attempt to locate presence of the headend device 14 on a wireless network (212). If the collaborative sound system application 42 is not able to locate the headend device 14 on the network ("NO" 214), the mobile device 18A may continue to attempt to locate the headend device 14 on the network, while also potentially presenting troubleshooting tips to assist the user in locating the headend device 14 (212). However, if the collaborative sound system application 42 locates the headend device 14 ("YES" 214), the collaborative sound system application 42 may establish the session 22A and register with the headend device 14 via the session 22A (216), effectively enabling the headend device 14 to identify the mobile device 18A as a device that includes a speaker 20A and is able to participate in the collaborative surround sound system 10.

After registering with the headend device 14, the collaborative sound system application 42 may invoke the data collection engine 46, which collects the mobile device data 60 in the manner described above (218). The data collection engine 46 may then send the mobile device data 60 to the headend device 14 (220). The data retrieval engine 32 of the headend device 14 receives the mobile device data 60 (221) and determines whether this mobile device data 60 includes location data specifying a location of the mobile device 18A relative to the headend device 14 (222). If the location data is insufficient to enable the headend device 14 to accurately locate the mobile device 18A (such as GPS data that is only accurate to within 30 feet) or if location data is not present in the mobile device data 60 ("NO" 222), the data retrieval engine 32 may invoke the location module 38, which interfaces with the location module 48 of the data collection engine 46 invoked by the collaborative sound system application 42 to send the tone 61 to the location module 48 of the mobile device 18A (224). The location module 48 of the mobile device 18A then passes this tone 61 to the audio playback module 44, which interfaces with the speaker 20A to reproduce the tone 61 (226).

Meanwhile, the location module 38 of the headend device 14 may, after sending the tone 61, interface with a microphone to detect the reproduction of the tone 61 by the speaker 20A (228). The location module 38 of the headend device 14 may then determine the location of the mobile device 18A based on detected reproduction of the tone 61 (230). After determining the location of the mobile device 18A using the tone 61, the data retrieval module 32 of the headend device 18 may update the mobile device data 60 to include the determined location, thereby generating the updated mobile device data 64 (231).

The headend device 14 may then determine whether to re-locate one or more of the mobile devices 18 in the manner described above (FIG. 8B; 232). If the headend device 14 determines to relocate, as one example, the mobile device 18A ("YES" 232), the headend device 14 may invoke the image generation module 160 to generate the first image 170A for the display device 164 of the mobile device 18A (234) and the second image 172A for the display device 166 of the source audio device 12 coupled to the headend system 14 (236). The image generation module 160 may then interface with the display device 164 of the mobile device 18A to display the first image 170A (238), while also interfacing with the display device 166 of the audio source device 12 coupled to the headend system 14 to display the second image 172A (240). The location module 38 of the headend device 14 may determine an updated current location of the mobile device 18A (242), where the location module 38 may determine whether the mobile device 18A has been properly positioned based on the intended location of the virtual speaker to be supported by the mobile device 18A (such as the SL virtual speaker shown in the examples of FIGS. 7A-7C) and the updated current location (244).

If not properly positioned ("NO" 244), the headend device 14 may continue in the manner described above to generate the images (such as the images 170B and 172B) for display via the respective displays 164 and 166 reflecting the current location of the mobile device 18A relative to the intended location of the virtual speaker to be supported by the mobile device 18A (234-244). When properly positioned ("YES" 244), the headend device 14 may receive a confirmation that the mobile device 18A will participate to support the corresponding one of the virtual surround sound speakers of the collaborative surround sound system 10.

Referring back to FIG. 8B, after re-locating one or more of the mobile devices 18, if the data retrieval module 32 determines that location data is present in the mobile device data 60 (or sufficiently accurate to enable the headend device 14 to locate the mobile device 18 with respect to the headend device 14) or after generating the updated mobile device data 64 to include the determined location, the data retrieval module 32 may determine whether it has finished retrieving the mobile device data 60 from each of mobile devices 18 registered with headend device 14 (246). If the data retrieval module 32 of the headend device 14 is not finished retrieving the mobile device data 60 from each of the mobile devices 18 ("NO" 246), the data retrieval module 32 continues to retrieve the mobile device data 60 and generate the updated mobile device data 64 in the manner described above (221-246). However, if the data retrieval module 32 determines that it has finished collecting the mobile device data 60 and generating the updated mobile device data 64 ("YES" 246), the data retrieval module 32 passes the updated mobile device data 64 to the audio rendering engine 36.

The audio rendering engine 36 may, in response to receiving this updated mobile device data 64, retrieve the source audio data 37 (248). The audio rendering engine 36 may, when rendering the source audio data 37, may then render audio signals 66 from the source audio data 37 based on the mobile device data 64 in the manner described above (250). In some examples, the audio rendering engine 36 may first determine speaker sectors that represent sectors at which speakers should be placed to accommodate playback of multi-channel source audio data 37. For example, 5.1 channel source audio data includes a front left channel, a center channel, a front right channel, a surround left channel, a surround right channel and a subwoofer channel. The subwoofer channel is not directional or worth considering given that low frequencies typically provide sufficient impact regardless of the location of the subwoofer with respect to the headend device. The other five-channels, however, may need to be placed appropriately to provide the best sound stage for immersive audio playback. The audio rendering engine 36 may interface, in some examples, with the location module 38 to derive the boundaries of the room, whereby the location module 38 may cause one or more of the speakers 16 and/or the speakers 20 to emit tones or sounds so as to identify the location of walls, people, furniture, etc. Based on this room or object location information, the audio rendering engine 36 may determine speaker sectors for each of the front left speaker, center speaker, front right speaker, surround left speaker and surround right speaker.

Based on these speaker sectors, the audio rendering engine 36 may determine a location of virtual speakers of the collaborative surround sound system 10. That is, the audio rendering engine 36 may place virtual speakers within each of the speaker sectors often at optimal or near optimal locations relative to the room or object location information. The audio rendering engine 36 may then map mobile devices 18 to each virtual speaker based on mobile device data 18.

For example, the audio rendering engine 36 may first consider the location of each of the mobile devices 18 specified in the updated mobile device data 60, mapping those devices to virtual speakers having a virtual location closest to the determined location of the mobile devices 18. The audio rendering engine 36 may determine whether or not to map more than one of the mobile devices 18 to a virtual speaker based on how close currently assigned one is to the location of the virtual speaker. Moreover, the audio rendering engine 36 may determine to map two or more of the mobile devices 18 to the same virtual speaker when the refined power data 62 associated with one of the two or more of the mobile devices 18 is insufficient to playback the source audio data 37 in its entirety. The audio rendering engine 36 may also map these mobile devices 18 based on other aspects of the mobile device data 60, including the speaker characteristics.

In any event, the audio rendering engine 36 may then instantiate or otherwise define pre-processing functions to render audio signals 66 from source audio data 37, as described in more detail above. In this way, the audio rendering engine 36 may render source audio data 37 based on the location of virtual speakers and the mobile device data 60. As noted above, the audio rendering engine 36 may consider the mobile device data 60 from each of the mobile devices 18 in the aggregate or as a whole when processing this audio data, yet transmit separate audio signals 66 or portions thereof to each of the mobile devices 18. Accordingly, the audio rendering engine 36 transmits rendered audio signals 66 to mobile devices 18 (252).

In response to receiving this rendered audio signals 66, the collaborative sound system application 42 interfaces with the audio playback module 44, which in turn interfaces with the speaker 20A to play the rendered audio signals 66 (254). As noted above, the collaborative sound system application 42 may periodically invoke the data collection engine 46 to determine whether any of the mobile device data 60 has changed or been updated (256). If the mobile device data 60 has not changed ("NO" 256), the mobile device 18A continues to play the rendered audio signals 66 (254). However, if the mobile device data 60 has changed or been updated ("YES" 256), the data collection engine 46 may transmit this changed mobile device data 60 to the data retrieval engine 32 of the headend device 14 (258).

The data retrieval engine 32 may pass this changed mobile device data to the audio rendering engine 36, which may modify the pre-processing functions for processing the channel to which the mobile device 18A has been mapped via the virtual speaker construction based on the changed mobile device data 60. As is described in more detail above, the commonly updated or changed mobile device data 60 changes due to changes in power consumption or because the mobile device 18A is pre-occupied with another task, such as a voice call that interrupts audio playback. In this way, the audio rendering engine 36 may render audio signals 66 from source audio data 37 based on the updated mobile device data 64 (260).

In some instances, the data retrieval engine 32 may determine that the mobile device data 60 has changed in the sense that the location module 38 of the data retrieval module 32 may detect a change in the location of the mobile device 18A. In other words, the data retrieval module 32 may periodically invoke the location module 38 to determine the current location of the mobile devices 18 (or, alternatively, the location module 38 may continually monitor the location of the mobile devices 18). The location module 38 may then determine whether one or more of the mobile devices 18 have been moved, thereby enabling the audio rendering engine 36 to dynamically modify the pre-processing functions to accommodate ongoing changes in location of the mobile devices 18 (such as might happen, for example, if a user picks up the mobile device to view a text message and then sets the mobile device back down in a different location). Accordingly, the technique may be applicable in dynamic settings to potentially ensure that virtual speakers remain at least proximate to optimal locations during the entire playback even though the mobile devices 18 may be moved or relocated during playback.

Figure 9A:
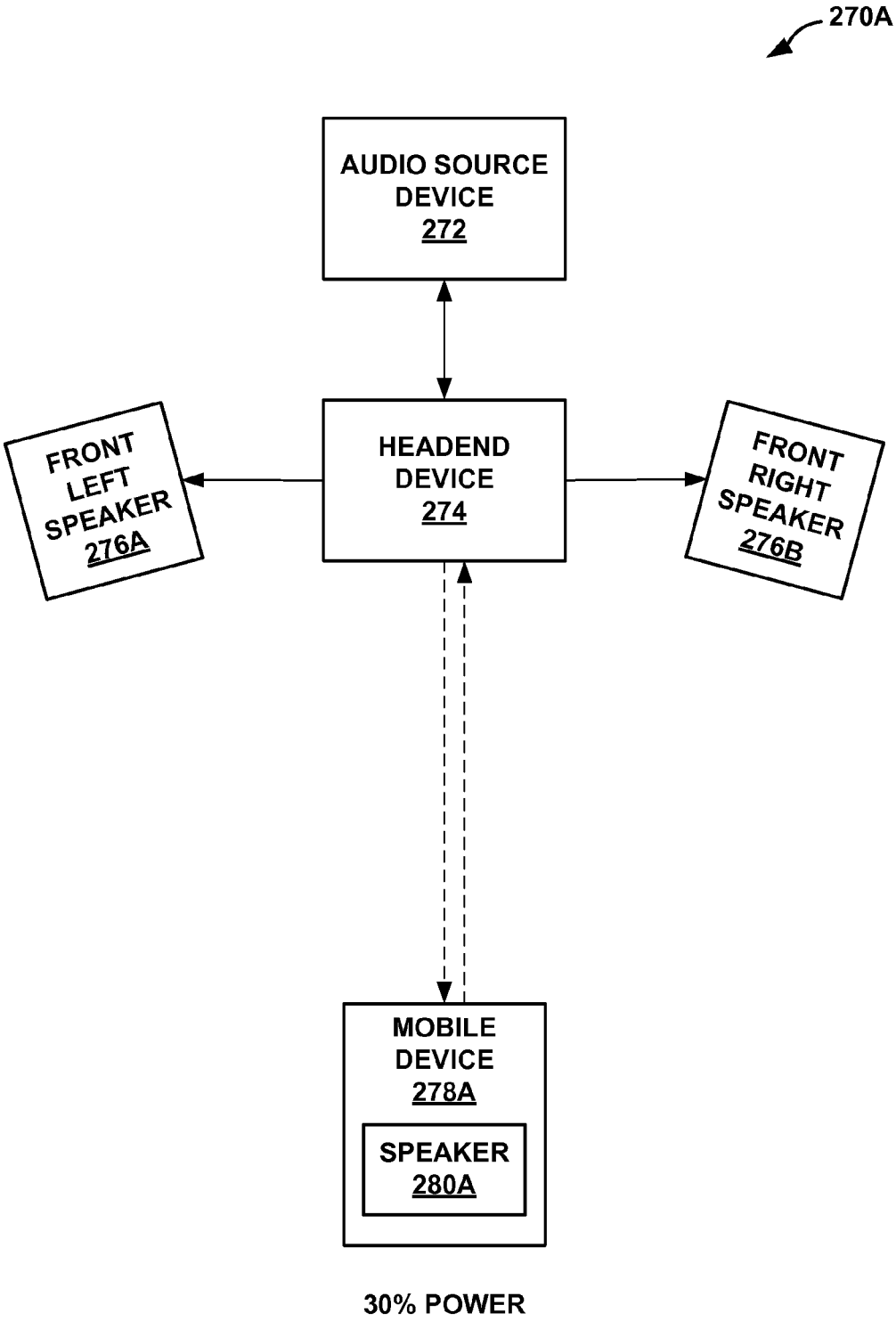
FIGS. 9A-9C are block diagrams illustrating various configurations of a collaborative surround sound system formed in accordance with the techniques described in this disclosure.
Figure 9B:
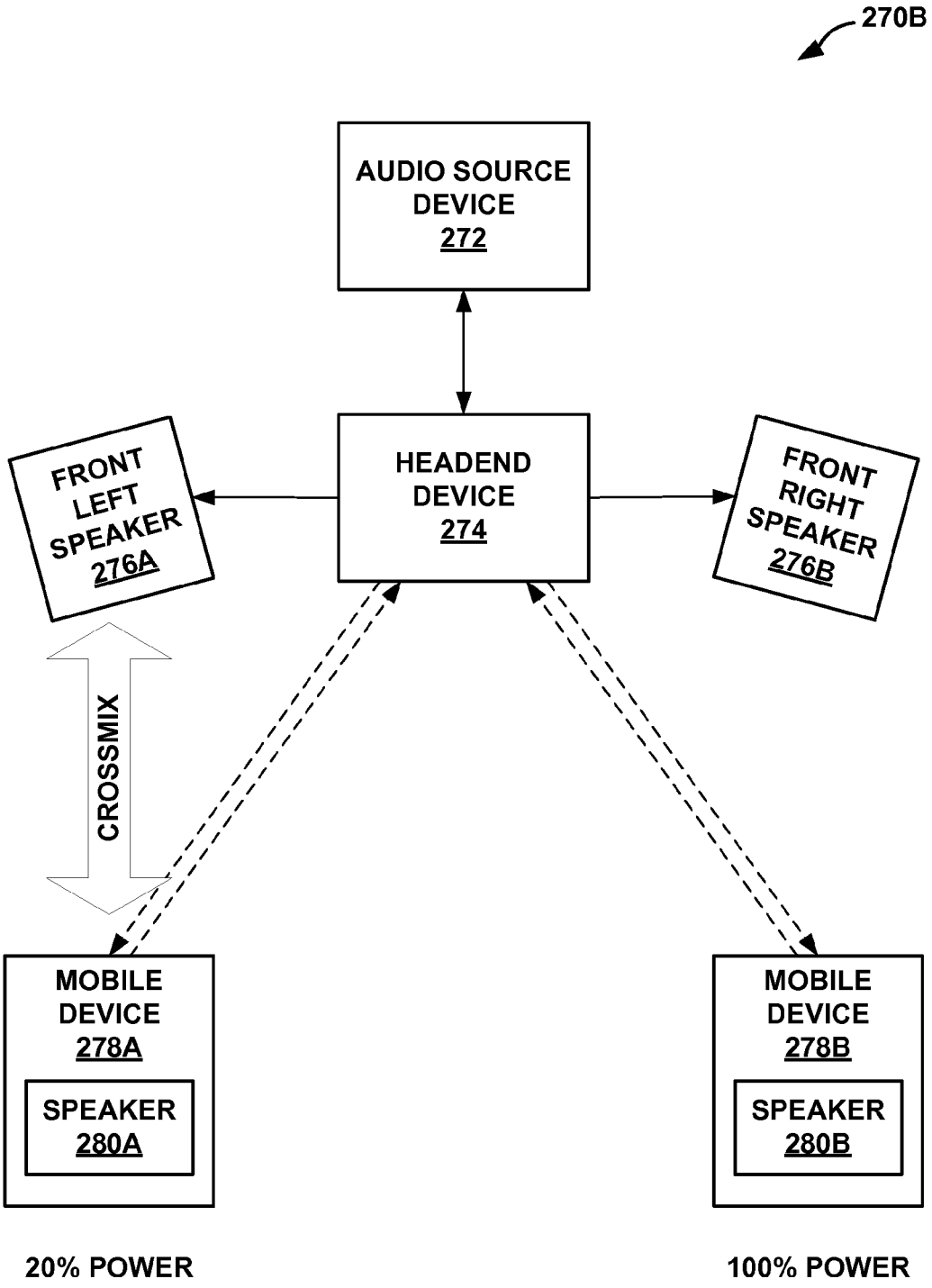
Figure 9C:
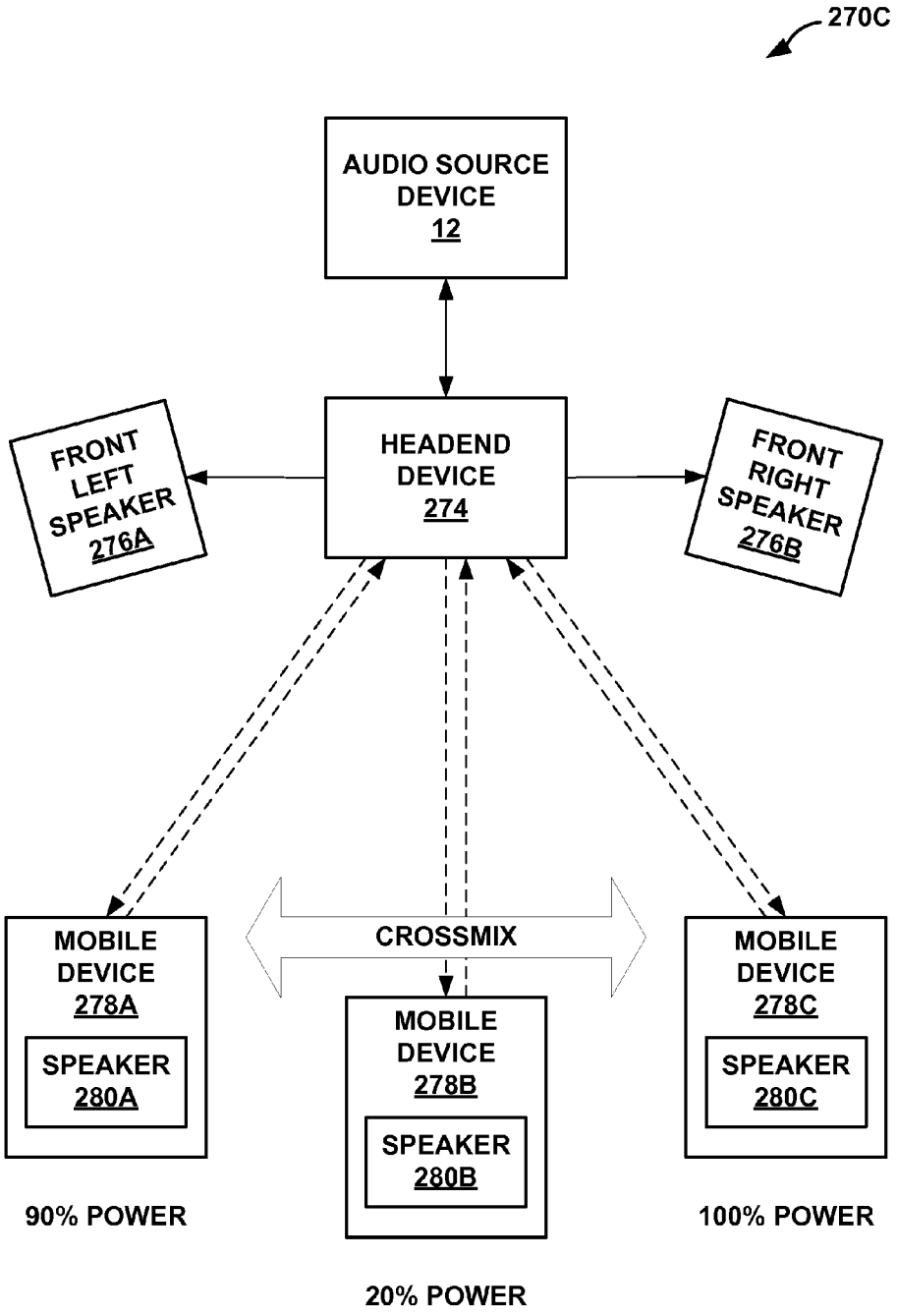

FIGS. 9A-9C are block diagrams illustrating various configurations of a collaborative surround sound system 270A-270C formed in accordance with the techniques described in this disclosure. FIG. 9A is a block diagram illustrating a first configuration of the collaborative surround sound system 270A. As shown in the example of FIG. 9A, the collaborative surround sound system 270A includes a source audio device 272, a headend device 274, front left and front right speakers 276A, 276B ("speakers 276") and a mobile device 278A that includes a speaker 280A. Each of the devices and/or the speakers 272-278 may be similar or substantially similar to the corresponding one of the devices and/or the speakers 12-18 described above with respect to the examples of FIGS. 1, 2, 3A-3C, 5, 8A-8C.

The audio rendering engine 36 of the headend device 274 may therefore receive the updated mobile device data 64 in the manner described above that includes the refined power data 62. The audio rendering engine 36 may effectively perform audio distribution using the constrained vector-based dynamic amplitude panning aspects of the techniques described above in more detail. For this reason, the audio rendering engine 36 may be referred to as an audio distribution engine. The audio rendering engine 36 may perform this constrained vector-based dynamic amplitude panning based on the updated mobile device data 64, including the refined power data 62.

In the example of FIG. 9A, it is assumed that only a single mobile device 278A is participating in support of one or more virtual speakers of the collaborative surround sound system 270A. In this example, there are only two speakers 276 and the speaker 280A of the mobile device 278A participating in the collaborative surround sound system 270A, which is not typically sufficient to render 5.1 surround sound formats, but may be sufficient for other surround sound formats, such as Dolby surround sound formats. In this example, it is assumed that the refined power data 62 indicates that the mobile device 278A has only 30% power remaining.

In rendering the audio signals for the speakers in support of the virtual speakers of the collaborative surround sound system 270A, the headend device 274 may first consider this refined power data 62 in relation to the duration of the source audio data 37 to be played by the mobile device 278A. To illustrate, the headend device 274 may determine that, when playing the assigned one or more channels of the source audio data 37 at full volume, the 30% power level identified by the refined power data 62 will enable the mobile device 278A to play approximately 30 minutes of the source audio data 37, where this 30 minutes may be referred to as an expected power duration. The headend device 274 may then determine that the source audio data 37 has a source audio duration of 50 minutes. Comparing this source audio duration to the expected power duration, the audio rendering engine 36 of the headend device 274 may render the source audio data 37 using the constrained vector based dynamic amplitude panning to generate audio signals for playback by the mobile device 278A that increase the expected power duration so that it may exceed the source audio duration. As one example, the audio rendering engine 36 may determine that, by lowering the volume by 6 dB, the expected power duration increases to approximately 60 minutes. As a result, the audio rendering engine 36 may define a pre-processing function to render audio signals 66 for mobile device 278A that have been adjusted in terms of the volume to be 6 dB lower.

The audio rendering engine 36 may periodically or continually monitor the expected power duration of the mobile device 278A updating or re-defining the pre-processing functions to enable the mobile device 278A to be able to playback the source audio data 37 in its entirety. In some examples, a user of the mobile device 278A may define preferences that specify cutoffs or other metrics with respect to power levels. That is, the user may interface with the mobile device 278A to, as one example, require that, after playback of the source audio data 37 is complete, the mobile device 278A have at least a specific amount of power remaining, e.g., 50 percent. The user may desire to set such power preferences so that the mobile device 278A may be employed for other purposes (e.g., emergency purposes, a phone call, email, text messaging, location guidance using GPS, etc.) after playback of the source audio data 37 without having to charge the mobile device 278A.

FIG. 9B is a block diagram showing another configuration of a collaborative surround sound system 270B that is substantially similar to the collaborative surround sound system 270A shown in the example of FIG. 9A, except that the collaborative surround sound system 270B includes two mobile devices 278A, 278B, each of which includes a speaker (respectively, speakers 280A and 280B). In the example of FIG. 9B, it is assumed that the audio rendering engine 36 of the headend device 274 has received refined power data 62 indicating that the mobile device 278A has only 20% of its battery power remaining, while the mobile device 278B has 100% of its battery power remaining. As described above, the audio rendering engine 36 may compare an expected power duration of the mobile device 278A to the source audio duration determined for the source audio data 37.

If the expected power duration is less than the source audio duration, the audio rendering engine 36 may then render audio signals 66 from the source audio data 37 in a manner that enables mobile device 278A to playback the rendered audio signals 66 in its entirety. In the example of FIG. 9B, the audio rendering engine 36 may render the surround sound left channel of source audio data 37 to crossmix one or more aspects of this surround sound left channel with the rendered front left channel of the source audio data 37. In some instances, the audio rendering engine 36 may define a pre-processing function that crossmixes some portion of the lower frequencies of the surround sound left channel with the front left channel, which may effectively enable the mobile device 278A to act as a tweeter for high frequency content. In some instances, the audio rendering engine 36 may crossmix this surround sound left channel with the front left channel and reduce the volume in the manner described above with respect to the example of FIG. 9A to further reduce power consumption by the mobile device 278A while playing the audio signals 66 corresponding to the surround sound left channel. In this respect, the audio rendering engine 36 may apply one or more different pre-processing functions to process the same channel in an effort to reduce power consumption by the mobile device 278A while playing audio signals 66 corresponding to one or more channels of the source audio data 37.

FIG. 9C is a block diagram showing another configuration of collaborative surround sound system 270C that is substantially similar to the collaborative surround sound system 270A shown in the example of FIG. 9A and the collaborative surround sound system 270B shown in the example of FIG. 9B, except that the collaborative surround sound system 270C includes three mobile devices 278A-278C, each of which includes a speaker (respectively, speakers 280A-280C). In the example of FIG. 9C, it is assumed that the audio rendering engine 36 of the headend device 274 has received the refined power data 62 indicating that the mobile device 278A has 90% of its battery power remaining, while the mobile device 278B has 20% of its battery power remaining and the mobile device 278C has 100% of its battery power remaining As described above, the audio rendering engine 36 may compare an expected power duration of the mobile device 278B to the source audio duration determined for the source audio data 37.

If the expected power duration is less than the source audio duration, the audio rendering engine 36 may then render audio signals 66 from the source audio data 37 in a manner that enables mobile device 278B to playback rendered audio signals 66 in their entirety. In the example of FIG. 9C, the audio rendering engine 36 may render audio signals 66 corresponding to the surround sound center channel of source audio data 37 to crossmix one or more aspects of this surround sound center channel with the surround sound left channel (associated with the mobile device 278A) and the surround sound right channel of the source audio data 37(associated with the mobile device 278C). In some surround sound formats, such as 5.1 surround sound formats, this surround sound center channel may not exist, in which case the headend device 274 may register the mobile device 278B as assisting in support of one or both of the surround sound left virtual speaker and the surround sound right virtual speaker. In this case, the audio rendering engine 36 of the headend device 274 may reduce the volume of audio signals 66 rendered from source audio data 37 that are sent to the mobile device 278B while increasing the volume of the rendered audio signals 66 sent to one or both of the mobile device 278A and 278C in the manner described above with respect to the constrained vector based amplitude panning aspects of the techniques described above.

In some instances, the audio rendering engine 36 may define a pre-processing function that crossmixes some portion of the lower frequencies of the audio signals 66 associated with the surround sound center channel with one or more of the audio signals 66 corresponding to the surround sound left channel and the surround sound right channel, which may effectively enable the mobile device 278B to act as a tweeter for high frequency content. In some instances, the audio rendering engine 36 may perform this crossmix while also reducing the volume in the manner described above with respect to the example of FIGS. 9A, 9B to further reduced power consumption by the mobile device 278B while playing the audio signals 66 corresponding to the surround sound center channel. Again, in this respect, the audio rendering engine 36 may apply one or more different pre-processing functions to render the same channel in an effort to reduce power consumption by the mobile device 278B while playing the assigned one or more channels of the source audio data 37.

Figure 10:
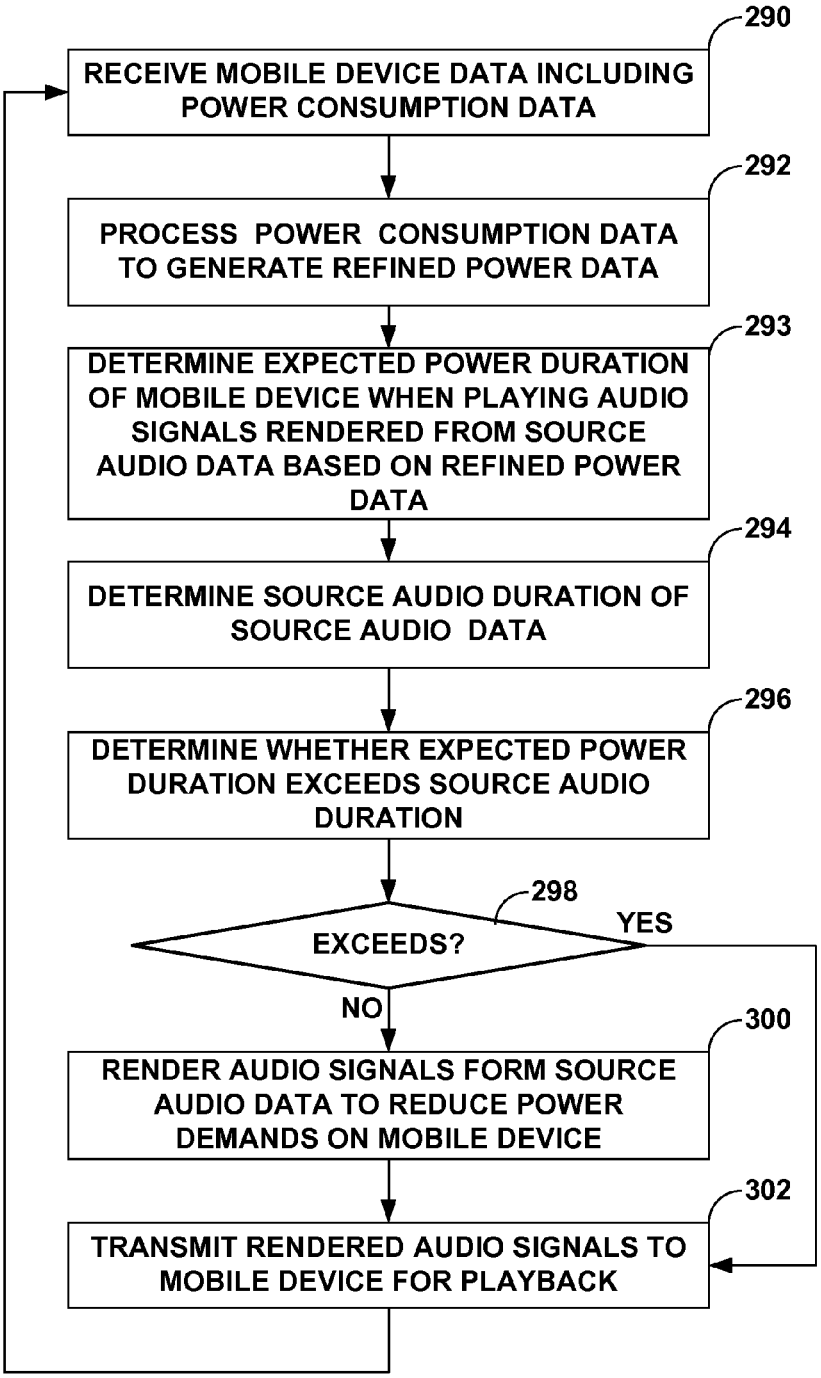
FIG. 10 is a flowchart illustrating exemplary operation of a headend device in implementing various power accommodation aspects of the techniques described in this disclosure.

FIG. 10 is a flowchart illustrating exemplary operation of a headend device, such as headend device 274 shown in the examples of FIGS. 9A-9C, in implementing various power accommodation aspects of the techniques described in this disclosure. As described above in more detail, the data retrieval engine 32 of the headend device 274 receives the mobile device data 60 from the mobile devices 278 that includes power consumption data (290). The data retrieval module 32 invokes the power processing module 34, which processes the power consumption data to generate the refined power data 62 (292). The power processing module 34 returns this refined power data 62 to the data retrieval module 32, which updates the mobile device data 60 to include this refined power data 62, thereby generating the updated mobile device data 64.

The audio rendering engine 36 may receive this updated mobile device data 64 that includes the refined power data 62. The audio rendering engine 36 may then determine an expected power duration of the mobile devices 278 when playing audio signals 66 rendered from source audio data 37 based on this refined power data 62 (293). The audio rendering engine 36 may also determine a source audio duration of source audio data 37 (294). The audio rendering engine 36 may then determine whether the expected power duration exceeds the source audio duration for any one of the mobile devices 278 (296). If all of the expected power durations exceed the source audio duration ("YES" 298), the headend device 274 may render audio signals 66 from the source audio data 37 to accommodate other aspects of the mobile devices 278 and then transmit rendered audio signals 66 to the mobile devices 278 for playback (302).

However, if at least one of the expected power durations does not exceed the source audio duration ("NO" 298), the audio rendering engine 36 may render audio signals 66 from the source audio data 37 in the manner described above to reduce power demands on the corresponding one or more mobile devices 278 (300). Headend device 274 may then transmit rendered audio signals 66 to mobile device 18 (302).

To illustrate these aspects of the techniques in more detail, consider a movie-watching example and several small use cases regarding how such a system may take advantage of the knowledge of each device's power usage. As mentioned before, the mobile devices may take different forms, phone, tablets, fixed appliances, computer etc. The central device also, it can be smart TV, receiver, or another mobile device with strong computational capability.

The power optimization aspects of the techniques described above is described with respect to audio signal distributions. Yet, these techniques may be extended to using a mobile device's screen and camera flash actuators as media playback extensions. The headend device, in this example, may learn from the media source and analyze for lighting enhancement possibilities. For example, in a movie with thunderstorms at night, some thunderclaps can be accompanied with ambient flashes, thereby potentially enhancing the visual experience to be more immersive. For a movie with a scene with candles around the watchers in a church, an extended source of candles can be rendered in screens of the mobile devices around the watchers. In this visual domain, power analysis and management for the collaborative system may be similar to the audio scenarios described above.

Figure 11:
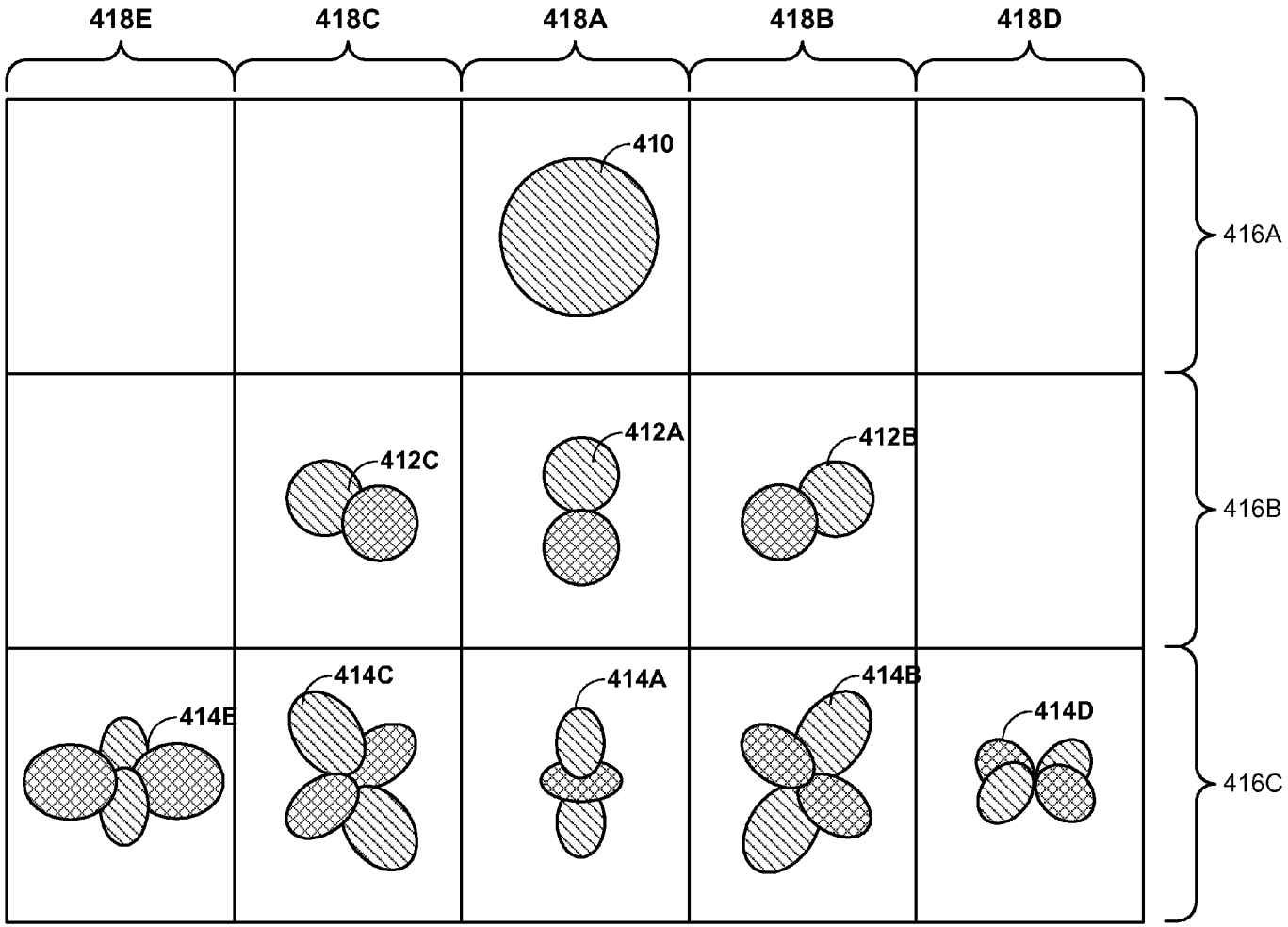
FIGS. 11-13 are diagrams illustrating spherical harmonic basis functions of various orders and sub-orders.
Figure 12:
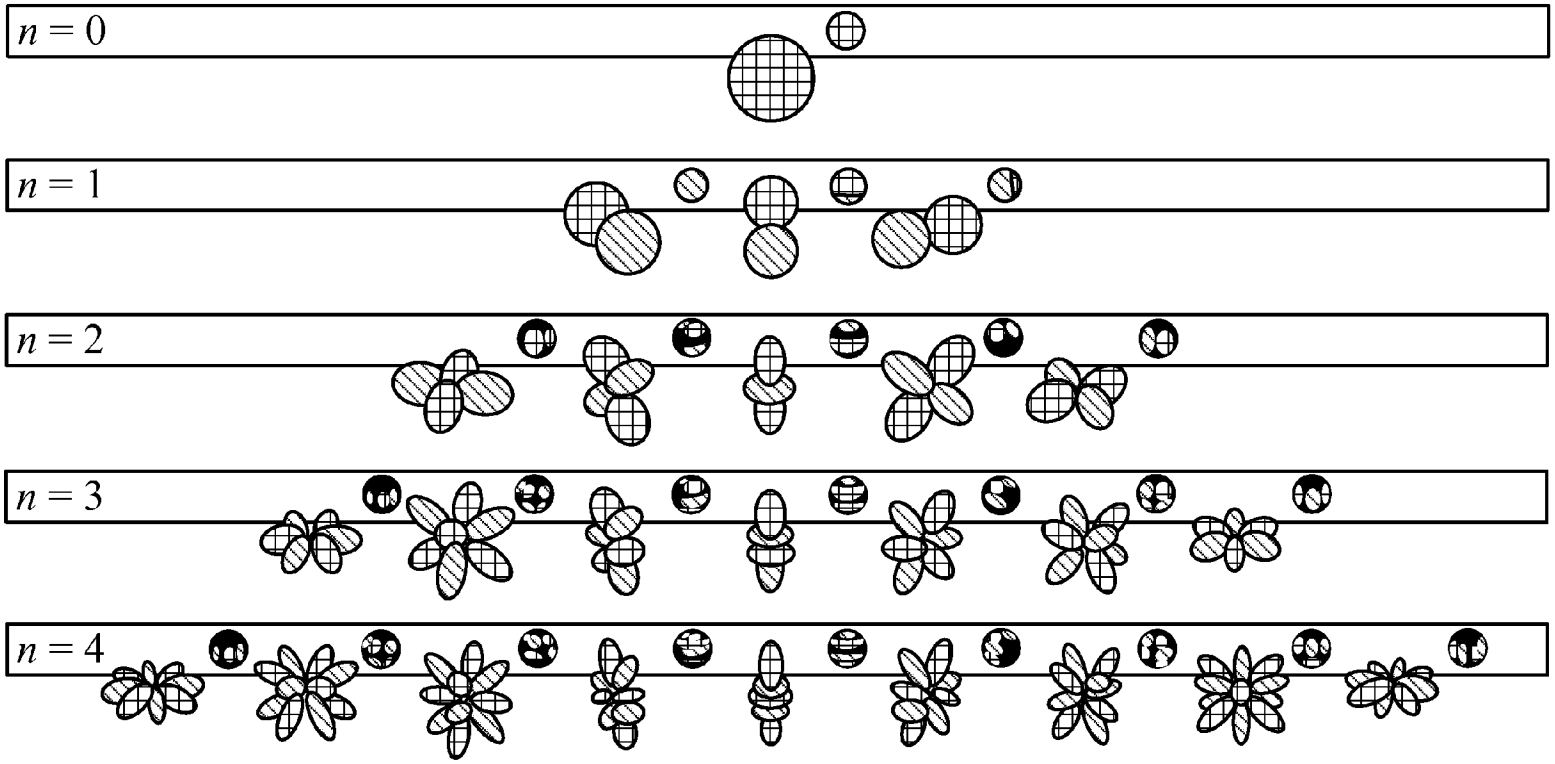
Figure 13:
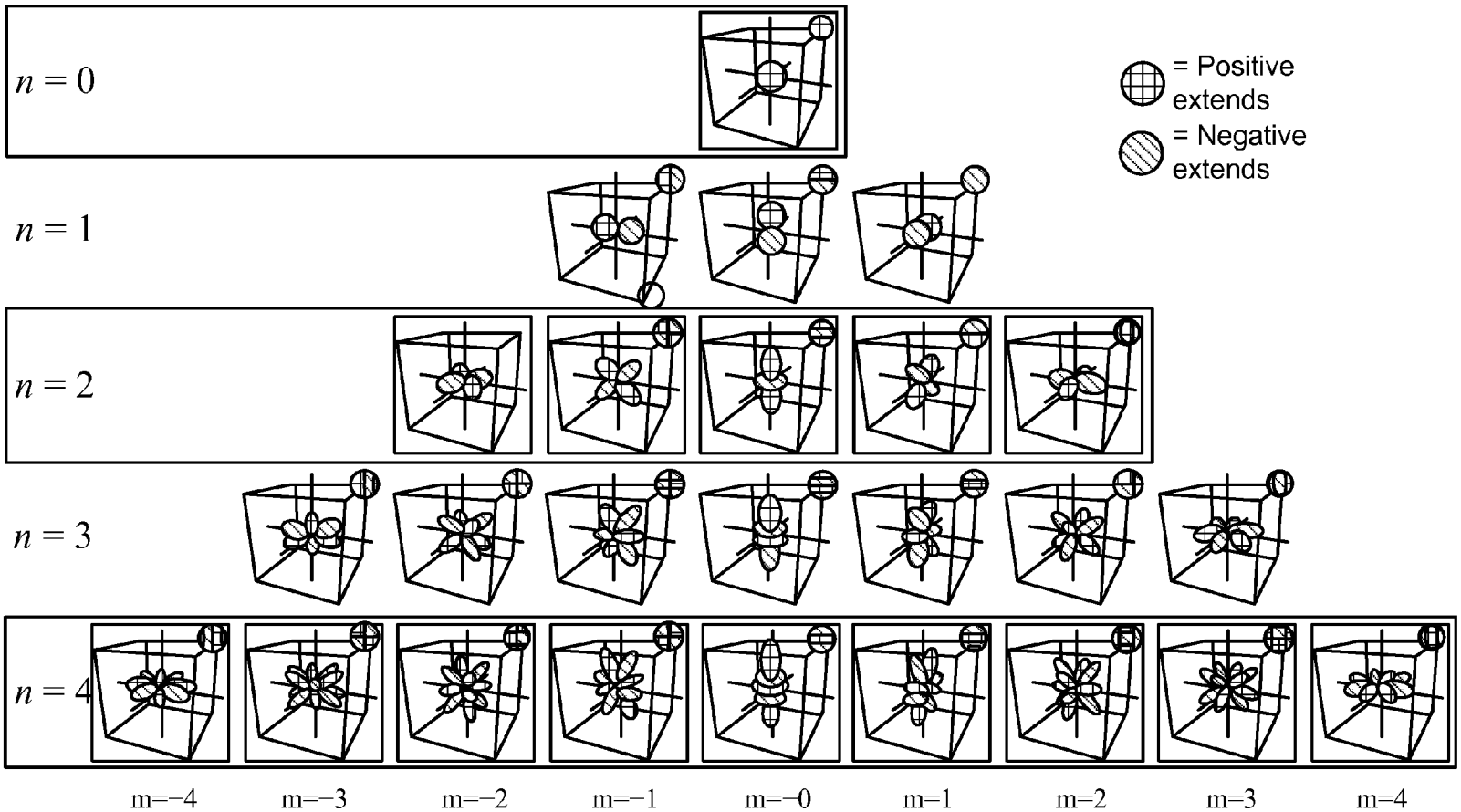

FIGS. 11-13 are diagrams illustrating spherical harmonic basis functions of various orders and sub-orders. These basis functions may be associated with coefficients, where these coefficients may be used to represent a sound field in two or three dimensions in a manner similar to how discrete cosine transform (DCT) coefficients may be used to represent a signal. The techniques described in this disclosure may be performed with respect to spherical harmonic coefficients or any other type of hierarchical elements that may be employed to represent a sound field. The following describes the evolution of spherical harmonic coefficients used to represent a sound field and that form higher order ambisonics audio data.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Another example of spatial audio format is the Spherical Harmonic coefficients (also known as Higher Order Ambisonics).

The input to a future standardized audio-encoder (a device which converts PCM audio representations to an bitstream—conserving the number of bits required per time sample) could optionally be one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using spherical harmonic coefficients (SHC)—where the coefficients represent 'weights' of a linear summation of spherical harmonic basis functions. The SHC, in this context, are also known as Higher Order Ambisonics signals.

There are various 'surround-sound' formats in the market. They range, for example, from the 5.1 home theatre system (which has been successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t}$$

This expression shows that the pressure $p_i$ at any point $\{r_r,\theta_r,\phi_r\}$ (which are expressed in spherical coordinates relative to the microphone capturing the sound field in this example) of the sound field can be represented uniquely by the SHC $A_n^m(k)$. Here, $$k = \frac{\omega}{c}, c$$

is the speed of sound (~343 m/s), $\{r_r,\theta_r,\phi_r\}$ is a point of reference (or observation point), $j_n(\square)$ is the spherical Bessel function of order n, and $Y_n^m(\theta_r,\phi_r)$ are the spherical harmonic basis functions of order n and suborder m. It can be recognized that the term in square brackets is a frequency-domain representation of the signal (i.e., $S(\omega,r_r,\theta_r,\phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 11 is a diagram illustrating a zero-order spherical harmonic basis function 410, first-order spherical harmonic basis functions 412A-412C and second-order spherical harmonic basis functions 414A-414E. The order is identified by the rows of the table, which are denoted as rows 416A-416C, with the row 416A referring to the zero order, the row 416B referring to the first order and the row 416C referring to the second order. The sub-order is identified by the columns of the table, which are denoted as columns 418A-418E, with the column 418A referring to the zero suborder, the column 418B referring to the first suborder, the column 418C referring to the negative first suborder, the column 418D referring to the second suborder and the column 418E referring to the negative second suborder. The SHC corresponding to the zero-order spherical harmonic basis function 410 may be considered as specifying the energy of the sound field, while the SHCs corresponding to the remaining higher-order spherical harmonic basis functions (e.g., the spherical harmonic basis functions 412A-412C and 414A-414E) may specify the direction of that energy.

FIG. 2 is a diagram illustrating spherical harmonic basis functions from the zero order (n=0) to the fourth order (n=4). As can be seen, for each order, there is an expansion of suborders m which are shown but not explicitly noted in the example of FIG. 2 for ease of illustration purposes.

FIG. 3 is another diagram illustrating spherical harmonic basis functions from the zero order (n=0) to the fourth order (n=4). In FIG. 3, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The SHC represents scene-based audio. For example, a fourth-order SHC representation involves $(1+4)^2=25$ coefficients per time sample.

To illustrate how these SHCs may be derived from an object-based description, consider the following equation. The coefficients $A_n^m(k)$ for the sound field corresponding to an individual audio object may be expressed as:

$$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\square)$ is the spherical Hankel function (of the second kind) of order n, and $\{r_s,\theta_s,\omega_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$.

The SHCs may also be derived from a microphone-array recording as follows:

$$a_n^m(t) = b_n(r_i, t) * \left\langle Y_n^m(\theta_i, \phi_i), m_i(t) \right\rangle$$

where, $a_n^m(t)$ are the time-domain equivalent of $A_n^m(k)$ (the SHC), the * represents a convolution operation, the <,> represents an inner product, $b_n(r_i,t)$ represents a time-domain filter function dependent on $r_i$, $m_i(t)$ are the $i^{th}$ microphone signal, where the $i^{th}$ microphone transducer is located at radius $r_i$, elevation angle $\theta_i$ and azimuth angle $\phi_i$. Thus, if there are 32 transducers in the microphone array and each microphone is positioned on a sphere such that, $r_i = a$, is a constant (such as those on an Eigenmike EM32 device from mhAcoustics), the 25 SHCs may be derived using a matrix operation as follows:

$$\begin{bmatrix} a_0^0(t) \\ a_1^{-1}(t) \\ \vdots \\ a_4^{-4}(t) \end{bmatrix} = \begin{bmatrix} b_0(a, t) \\ b_1(a, t) \\ \vdots \\ b_4(a, t) \end{bmatrix} * \begin{bmatrix} Y_0^0(\theta_1, \varphi_1) & Y_0^0(\theta_2, \varphi_2) & \dots & Y_0^0(\theta_{32}, \varphi_{32}) \\ Y_1^{-1}(\theta_1, \varphi_1) & Y_1^{-1}(\theta_2, \varphi_2) & \dots & Y_1^{-1}(\theta_{32}, \varphi_{32}) \\ \vdots & \vdots & \ddots & \vdots \\ Y_4^4(\theta_1, \varphi_1) & Y_4^4(\theta_2, \varphi_2) & \dots & Y_4^4(\theta_{32}, \varphi_{32}) \end{bmatrix} \begin{bmatrix} m_0(a, t) \\ m_1(a.t) \\ \vdots \\ m_{32}(a, t) \end{bmatrix}$$

The matrix in the above equation may be more generally referred to as $E_s(\theta,\phi)$, where the subscript s may indicate that the matrix is for a certain transducer geometry-set, s. The convolution in the above equation (indicated by the *), is on a row-by-row basis, such that, for example, the output $a_0^0(t)$ is the result of the convolution between $b_0(a,t)$ and the time series that results from the vector multiplication of the first row of the $E_s(\theta,\phi)$ matrix, and the column of microphone signals (which varies as a function of time—accounting for the fact that the result of the vector multiplication is a time series).

The techniques described in this disclosure may be implemented with respect to these spherical harmonic coefficients. To illustrate, the audio rendering engine 36 of the headend device 14 shown in the example of FIG. 2 may render audio signals 66 from source audio data 37, which may specify these SHC. The audio rendering engine 36 may implement various transforms to reproduce the sound field, possibly accounting for the locations of the speakers 16 and/or the speakers 20, to render various audio signals 66 that may more fully and/or accurately reproduce the sound field upon playback given that SHC may more fully and/or more accurately describe the sound field than object-based or channel-based audio data. Moreover, given that the sound field is often represented both more accurately and more fully using SHC, the audio rendering engine 36 may generate audio signals 66 tailored to most any location of the speakers 16 and 20. SHC may effectively remove the limitations on speaker locations that are pervasive in most any standard surround sound or multi-channel audio format (including the 5.1, 7.1 and 22.2 surround sound formats mentioned above).

It should be understood that, depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially. In addition, while certain aspects of this disclosure are described as being performed by a single module or unit for purposes of clarity, it should be understood that the techniques of this disclosure may be performed by a combination of units or modules associated with a video coder.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol.

In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware Various embodiments of the techniques have been described. These and other embodiments are within the scope of the following claims.

The invention claimed is:

1. A method comprising:

identifying two or more mobile devices of a plurality of mobile devices participating in a collaborative surround sound system capable of representing a virtual speaker of the collaborative surround sound system;

determining a constraint that impacts playback of audio signals rendered from audio source data by at least one of the identified two or more mobile devices;

determining, based on the constraint, a gain for the at least one of the identified two or more mobile devices; and rendering the audio source data using the gain to generate audio signals that reduce the impact of the determined constraint during playback of the audio signals by the identified two or more mobile devices.

2. The method of claim 1, wherein determining the constraint comprises:

determining an expected power duration that indicates an expected duration that the at least one of the identified two or more mobile device will have sufficient power to playback the audio signals rendered from the audio source data;

determining a source audio duration that indicates a playback duration of the audio signals rendered from the audio source data; and when the source audio duration exceeds the expected power duration, determining the expected power duration as the constraint.

3. The method of claim 2, wherein rendering the audio source data using the gain comprises rendering the audio source data using the gain to generate the audio signals such that an expected power duration to playback the audio signals is less than the source audio duration.

4. The method of claim 1, wherein determining the constraint comprises determining a frequency dependent constraint, and wherein rendering the audio source data using the at least one gain comprises rendering the audio source data using the at least one gain to generate the audio signals such that an expected power duration to playback the audio signals by the at least one of the identified two or more mobile devices is less than a duration of the audio source data.

5. The method of claim 1, wherein rendering the audio source data comprises rendering the audio source data using an expected power duration, as the constraint to generate the audio signals, to playback the audio signals by the at least one of the identified two or more mobile devices such that the expected power duration to playback the audio signals by the at least one of the identified two or more of the mobile devices is less than a duration of the audio source data.

6. The method of claim 1, wherein the plurality of mobile devices comprise a first mobile device, a second mobile device and a third mobile device, wherein the virtual speaker comprises one of a plurality of virtual speakers of the collaborative surround sound system, wherein the constraint comprises one or more expected power durations, the one or more expected power duration each indicating an expected duration for which one of the plurality of mobile devices will have sufficient power to playback audio signals rendered from the audio source data, and wherein determining the gain for the at least one of the identified two or more mobile devices comprises:

computing volume gains $g_1$, $g_2$ and $g_3$ for the first mobile device, the second mobile device and the third mobile device, respectively, in accordance with the following equation:

$$\begin{bmatrix} g_1 \\ g_2 \\ g_3 \end{bmatrix} = \begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

wherein $a_l$, $a_2$ and $a_3$ denote a scalar power factor for the first mobile device, a scalar power factor for the second mobile device and a scalar power factor for the third mobile device, wherein $l_{11}$, $l_{12}$ denote a vector identifying a location of the first mobile device relative to a headend device, $l_{21}$, $l_{22}$ denote a vector identifying a location of the second mobile device relative to the headend device and $l_{31}$, $l_{32}$ denote a vector identifying a location of the third mobile device relative to the headend device, and wherein $p_1$, $p_2$ denote a vector identifying a specified location relative to the headend device of one of the plurality of virtual speakers represented by the first mobile device, the second mobile device and the third mobile device.

7. The method of claim 1, wherein rendering the audio source data using the gain comprises performing a constrained vector based dynamic amplitude panning with respect to the audio source data to generate the audio signals so as to reduce the impact of the determined constraint on playback of the audio signals by the at least one of the two or more mobile devices.

8. The method of claim 1, wherein the virtual speaker of the collaborative surround sound system appears to be placed in a location different than a location of at least one of the two or more mobile devices.

9. The method of claim 1, wherein the audio source data comprises one of a higher order ambisonic audio source data, a multi-channel audio source data and an object-based audio source data.

10. A headend device comprising:

one or more processors configured to identify two or more mobile devices of a plurality of mobile devices participating in a collaborative surround sound system capable of representing a virtual speaker of the collaborative surround sound system, determine a constraint that impacts playback of audio signals rendered from audio source data by at least one of the identified two or more mobile devices, determine, based on the constraint, a gain for the at least one of the identified two or more mobile devices, and render the audio source data using the gain to generate audio signals that reduce the impact of the determined constraint during playback of the audio signals by the identified two or more mobile devices; and a memory configured to store the audio signals.

11. The headend device of claim 10, wherein the one or more processors are further configured to, when determining the constraint, determine an expected power duration that indicates an expected duration that the at least one of the identified two or more mobile devices will have sufficient power to playback the audio signals rendered from the audio source data, determine a source audio duration that indicates a playback duration of the audio signals from the audio source data, and, when the source audio duration exceeds the expected power duration, determining the expected power duration as the constraint.

12. The headend device of claim 11, wherein the one or more processors are configured to render the audio source data using the gain to generate the audio signals such that an expected power duration to playback the audio signals is less than the source audio duration.

13. The headend device of claim 10, wherein the one or more processors are configured to determine a frequency dependent constraint, and wherein the one or more processors are configured to render the audio source data using the determined frequency dependent constraint to generate the audio signals such that an expected power duration to playback the audio signals by the at least one of the identified two or more of the mobile devices is less than a duration of the source audio data indicating a playback duration of the audio signals.

14. The headend device of claim 10, wherein the virtual speaker comprises one of a plurality of virtual speakers of the collaborative surround sound system, wherein the at least one of the identified two or more mobile devices comprises one of a plurality of mobile devices configured to support the plurality of virtual speakers, wherein the one or more processors are configured to render the audio source data using an expected power duration, as the constraint to generate the audio signals, to playback the audio signals by the at least one of the identified two or more mobile devices such that the expected power duration to playback the audio signals by the at least one of the identified two or more of the mobile devices is less than a duration of the source audio.

15. The headend device of claim 10, wherein the plurality of mobile devices comprise a first mobile device, a second mobile device and a third mobile device, wherein the virtual speaker comprises one of a plurality of virtual speaker of the collaborative surround sound system, wherein the constraint comprises one or more expected power duration, the one or more expected power durations each indicating an expected duration that one of the plurality of mobile devices will have sufficient power to playback audio signals rendered from the audio source, and wherein the one or more processors are configured to compute volume gains $g_1$, $g_2$ and $g_3$ for the first mobile device, the second mobile device and the third mobile device, respectively, in accordance with the following equation:

$$\begin{bmatrix} g_1 \\ g_2 \\ g_3 \end{bmatrix} = \begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

wherein $a_l$, $a_2$ and $a_3$ denote a scalar power factor for the first mobile device, a scalar power factor for the second mobile device and a scalar power factor for the third mobile device, wherein $l_{11}$, $l_{12}$ denote a vector identifying a location of the first mobile device relative to a headend device, $l_{21}$, $l_{22}$ denote a vector identifying a location of the second mobile device relative to the headend device and $l_{31}$, $l_{32}$ denote a vector identifying a location of the third mobile device relative to the headend device, and wherein $p_1$, $p_2$ denote a vector identifying a specified location relative to headend device of the plurality of virtual speakers represented by the first mobile device, the second mobile device and the third mobile device.

16. The headend device of claim 10, wherein the one or more processors are configured to perform a constrained vector based dynamic amplitude panning with respect to the audio source data to generate the audio signals so as to reduce the impact of the determined constraint on playback of the audio signals by the at least one of the identified two or more mobile device.

17. The headend device of claim 10, wherein the virtual speaker of the collaborative surround sound system appears to be placed in a location different than a location of the identified two or more mobile devices.

18. The headend device of claim 10, wherein the audio source data comprises one of a higher order ambisonic audio source data, a multi-channel audio source data and an object-based audio source data.

19. A headend device comprising:

means for identifying two or more mobile devices of a plurality of mobile devices participating in a collaborative surround sound system capable of representing a virtual speaker of the collaborative surround sound system;

means for determining a constraint that impacts playback of audio signals rendered from audio source data by at least one of the identified two or more mobile devices;

means for determining, based on the constraint, a gain for the at least one of the identified two or more mobile devices; and means for rendering the audio source data using the gain to generate audio signals that reduce the impact of the determined constraint during playback of the audio signals by the identified two or more mobile devices.

20. The headend device of claim 19, wherein the means for determining the constraint comprises:

means for determining an expected power duration that indicates an expected duration that the at least one of the identified two or more mobile devices will have sufficient power to playback the audio signals rendered from the audio source data;

means for determining a source audio duration that indicates a playback duration of the audio signals rendered from the audio source data; and means for determining, when the source audio duration exceeds the expected power duration, the expected power duration as the constraint.

21. The headend device of claim 20, wherein the means for rendering the audio source data comprises means for rendering the audio source data using the gain to generate the audio signals such that an expected power duration to playback the audio signals is less than a duration of the audio source data.

22. The headend device of claim 20, wherein the means for determining the constraint comprise means for determining a frequency dependent constraint, and wherein the means for rendering comprises means for rendering the audio source data using the at least one gain to generate the audio signals such that an expected power duration to playback the audio signals by the at least one of the identified two or more mobile devices is less than a duration of the audio source data.

23. The headend device of claim 19, wherein the means for rendering comprises means for performing dynamic spatial rendering of the audio source data using an expected power duration, as the constrain to generate the audio signals, to playback the audio signals by the at least one of the identified two or more mobile devices such that the expected power duration to playback the audio signals by the at least one of the identified two or more of the mobile devices is less than a duration of the source audio data.

24. The headend device of claim 19, wherein the plurality of mobile devices comprise a first mobile device, a second mobile device and a third mobile device, wherein the virtual speaker comprises one of a plurality of virtual speakers of the collaborative surround sound system, wherein the constraint comprises one or more expected power durations, the one or more expected power durations each indicating an expected duration that one of the plurality of mobile devices will have sufficient power to playback audio signals rendered from the audio source, and wherein the means for determining the gain for the at least one of the identified two or more mobile devices comprises:

means for computing volume gains $g_1$, $g_2$ and $g_3$ for the first mobile device, the second mobile device and the third mobile device, respectively, in accordance with the following equation:

$$\begin{bmatrix} g_1 \\ g_2 \\ g_3 \end{bmatrix} =$$

-continued $$\begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

wherein $a_1$, $a_2$ and $a_3$ denote a scalar power factor for the first mobile device, a scalar power factor for the second mobile device and a scalar power factor for the third mobile device, wherein $l_{11}$, $l_{12}$ denote a vector identifying a location of the first mobile device relative to a headend device, $l_{21}$, $l_{22}$ denote a vector identifying a location of the second mobile device relative to the headend device and $l_{31}$, $l_{32}$ denote a vector identifying a location of the third mobile device relative to the headend device, and wherein $p_1$, $p_2$ denote a vector identifying a specified location relative to the headend device of one of the plurality of virtual speakers repesented by the first mobile device, the second mobile device and the third mobile device.

25. The headend device of claim 19, wherein the means for rendering comprises means for performing a constrained vector based dynamic amplitude panning with respect to the audio source data to generate the audio signals so as to reduce the impact of the determined constraint on playback of the audio signals by the at least one of the identified two or more mobile devices.

26. The headend device of claim 19, wherein the virtual speaker of the collaborative surround sound system appears to be placed in a location different than a location of at least one of the two or more mobile devices.

27. The headend device of claim 19, wherein the audio source data comprises one of higher order ambisonic audio source data, a multi-channel audio source data and an object-based audio source data.

28. A non-transitory computer-readable storage medium having stored thereon instructions that, when executed cause one or more processors to:

identify two or more mobile devices of a plurality of mobile devices participating in a collaborative surround sound system capable of representing a virtual speaker of the collaborative surround sound system;

determine a constraint that impacts playback of audio signals rendered from audio source data by at least one of the identified two or more mobile devices;

determine, based on the constraint, a gain for the at least one of the identified two or more mobile devices; and render the audio source data using the gain to generate audio signals that reduce the impact of the determined constraint during playback of the audio signals by the plurality of mobile devices.

29. The non-transitory computer-readable storage medium of claim 28, wherein the instructions further cause, when executed, the one or more processors to, when determining the constraint, determine an expected power duration that indicates an expected duration that the at least one of the identified two or more mobile devices will have sufficient power to playback the audio signals rendered from the audio source data, determine a source audio duration that indicates a playback duration of the audio signals rendered from the audio source data, and, when the source audio duration exceeds the expected power duration, determining the expected power duration as the constraint.

30. The non-transitory computer-readable storage medium of claim 29, wherein the instructions further cause, when executed, the one or more processors to, when rendering the audio source data with the determined constraint, render the audio source data using the gain to generate the audio signals such that an expected power duration to playback the audio signals is less than a duration of the audio source data.

31. The non-transitory computer-readable storage medium of claim 28, wherein the instructions further cause, when executed, the one or more processors to, when determining the constraint, determine a frequency dependent constraint, and wherein the instructions further cause, when executed, the one or more processors to, when rendering, render the audio source data using the gain to generate the audio signals such that an expected power duration to playback the audio signals by the at least one of the identified two or more of the mobile devices is less than a duration of the audio source data.

32. The non-transitory computer-readable storage medium of claim 28, wherein the instructions further cause, when executed, the one or more processors to, when rendering, render the audio source data using an expected power duration, as the constraint to render the audio signals, to playback the audio signals by the at least one of the identified two or more mobile devices such that the expected power duration to playback the audio signals by the at least one of the identified two or more of the mobile devices is less than a duration of the audio source data.

33. The non-transitory computer-readable storage medium of claim 28, wherein the plurality of mobile devices comprise a first mobile device, a second mobile device and a third mobile device, wherein the virtual speaker comprises one of a plurality of virtual speakers of the collaborative surround sound system, wherein the constraint comprises one or more expected power duration, the one or more expected power duration each indicating an expected duration that one of the plurality of mobile devices will have sufficient power to playback audio signals rendered from the audio source data, and wherein the instructions further cause, when executed, the one or more processors to, when determining the gain for the at least one of the two or more mobile devices, compute volume gains $g_1$, $g_2$ and $g_3$ for the first mobile device, the second mobile device and the third mobile device, respectively, in accordance with the following equation:

$$\begin{bmatrix} g_1 \\ g_2 \\ g_3 \end{bmatrix} = \begin{bmatrix} a_1 l_{11} & a_2 l_{21} & a_3 l_{31} \\ a_1 l_{12} & a_2 l_{22} & a_3 l_{32} \end{bmatrix}^T \left[ \begin{bmatrix} a_1 l_{11} & a_2 l_{21} & a_3 l_{31} \\ a_1 l_{12} & a_2 l_{22} & a_3 l_{32} \end{bmatrix} \begin{bmatrix} a_1 l_{11} & a_2 l_{21} & a_3 l_{31} \\ a_1 l_{12} & a_2 l_{22} & a_3 l_{32} \end{bmatrix}^T \right]^{-1} \begin{bmatrix} p_1 \\ p_2 \end{bmatrix}$$

wherein $a_1$, $a_2$ and $a_3$ denote a scalar power factor for the first mobile device, a scalar power factor for the second mobile device and a scalar power factor for the third mobile device, wherein $l_{11}$, $l_{12}$ denote a vector identifying a location of the first mobile device relative to a headend device, $l_{21}$, $l_{22}$ denote a vector identifying a location of the second mobile device relative to the headend device and $l_{31}$, $l_{32}$ denote a vector identifying a location of the third mobile device relative to the headend device, and wherein $p_1$, $p_2$ denote a vector identifying a specified location relative to the headend device of one of the plurality of virtual speakers represented by the first mobile device, the second mobile device and the third mobile device.

34. The non-transitory computer-readable storage medium of claim 28, wherein the instructions further cause, when executed, the one or more processors to, when rendering the audio source data using the gain, perform a constrained vector based dynamic amplitude panning with respect to the audio source data to generate the audio signals so as to reduce the impact of the determined constraint on playback of the audio signals by the at least one of the two or more mobile devices.

35. The non-transitory computer-readable storage medium of claim 28, wherein the virtual speaker of the collaborative surround sound system appears to be placed in a location different than a location of at least one of the two or more mobile devices.

36. The non-transitory computer-readable storage medium of claim 28, wherein the audio source data comprises one of a higher order ambisonic audio source data, a multi-channel audio source data and an object-based audio source data.

* * * * *